US009294841B2

(12) United States Patent
Sahyoun

(10) Patent No.: US 9,294,841 B2
(45) Date of Patent: Mar. 22, 2016

(54) ACOUSTIC RADIATOR INCLUDING A COMBINATION OF A CO-AXIAL AUDIO SPEAKER AND PASSIVE RADIATOR

(76) Inventor: Joseph Y. Sahyoun, Redwood City, CA (US)

( * ) Notice: Subject to any disclaimer, the term of this patent is extended or adjusted under 35 U.S.C. 154(b) by 251 days.

(21) Appl. No.: 13/878,562

(22) PCT Filed: Oct. 11, 2011

(86) PCT No.: PCT/US2011/055843

§ 371 (c)(1),
(2), (4) Date: Apr. 9, 2013

(87) PCT Pub. No.: WO2012/051217

PCT Pub. Date: Apr. 19, 2012

(65) Prior Publication Data

US 2013/0195311 A1 Aug. 1, 2013

Related U.S. Application Data

(60) Provisional application No. 61/392,452, filed on Oct. 12, 2010.

(51) Int. Cl.
*H04R 7/02* (2006.01)
*H04R 1/28* (2006.01)
(Continued)

(52) U.S. Cl.
CPC ..... *H04R 7/02* (2013.01); *H04R 1/2834* (2013.01); *H04R 1/2896* (2013.01); *H04R 1/025* (2013.01);
(Continued)

(58) Field of Classification Search
CPC ..... H04R 1/025; H04R 1/02; H04R 1/026; H04R 1/021; H04R 1/1075; H04R 1/16; H04R 1/18; H04R 1/2834; H04R 1/2892; H04R 1/2896; H04R 2201/021; H04R 2499/11; H04R 2499/15
USPC ..... 381/386, 389, 345, 353, 354, 395, 398, 381/413, 423, 432, 152, 337, 346, 349, 186, 381/404, 86, 302, 71.4, 365
See application file for complete search history.

(56) References Cited

U.S. PATENT DOCUMENTS 3,772,466 A 11/1973 Hossbach
4,379,951 A 4/1983 Gabr
(Continued)

FOREIGN PATENT DOCUMENTS

JP 2000-069582 A 3/2000
WO 20120051217 4/2012

*Primary Examiner* — Davetta W Goins
*Assistant Examiner* — Jasmine Pritchard
(74) *Attorney, Agent, or Firm* — David E. Newhouse, Esq.

(57) ABSTRACT

The acoustic radiator of a coaxial structure of an active region surrounded by a passive region wherein the operating area of the active region is also included as a part of the passive region. The active region includes for example a fully assembled audio speaker that is flexibly suspended in an enclosure with the flexible suspension connected between the audio speaker and the opening of the enclosure with the audio speaker never coming into direct contact with any portion of the enclosure when energized or unenergized. In such configuration, the area of the audio speaker functions as active region the audio speaker of the acoustic radiator. The passive radiator function includes both the area of the complete audio speaker and the area of the enclosure that surrounds the audio speaker. In this configuration the audio speaker is a central portion of the passive radiator and thus it can be seen that the audio speaker and the passive radiator are effectively coaxially mounted one with the other.

8 Claims, 23 Drawing Sheets

(51) Int. Cl.

| | |
|---|---|
| *H04R 1/02* | (2006.01) |
| *H04R 1/10* | (2006.01) |
| *H04R 1/24* | (2006.01) |
| *H04R 7/04* | (2006.01) |

(52) U.S. Cl.

CPC ..... *H04R 1/1075* (2013.01); *H04R 1/24* (2013.01); *H04R 7/045* (2013.01); *H04R 2201/021* (2013.01); *H04R 2440/05* (2013.01); *H04R 2499/11* (2013.01); *H04R 2499/13* (2013.01)

(56) References Cited

U.S. PATENT DOCUMENTS

| | | | | |
|---|---|---|---|---|
| 5,687,247 | A | 11/1997 | Proni | |
| 6,863,152 | B1 * | 3/2005 | Sahyoun | H04R 7/20 181/157 |
| 7,318,496 | B2 | 1/2008 | Sahyoun | |
| 8,131,005 | B2 * | 3/2012 | Lemarquand | H04R 9/027 381/362 |
| 8,335,333 | B2 * | 12/2012 | Saiki | H04R 1/2803 381/345 |
| 9,042,582 | B2 | 5/2015 | Chan et al. | |
| 2004/0105565 | A1 * | 6/2004 | Butters | H04R 1/2834 381/347 |
| 2007/0201712 | A1 * | 8/2007 | Saiki | H04R 1/2834 381/186 |
| 2007/0258617 | A1 * | 11/2007 | Henry | H04R 9/06 381/423 |
| 2011/0026751 | A1 * | 2/2011 | Hilbowicki | H04R 1/2807 381/345 |
| 2014/0029782 | A1 * | 1/2014 | Rayner | H04R 1/2834 381/386 |
| 2014/0185838 | A1 | 7/2014 | Chan et al. | |
| 2015/0172818 | A1 * | 6/2015 | Gladwin | H04R 3/12 381/337 |

* cited by examiner

ACOUSTIC RADIATOR INCLUDING A COMBINATION OF A CO-AXIAL AUDIO SPEAKER AND PASSIVE RADIATOR

RELATED APPLICATIONS

This Application claims all benefits applicable under 35 U.S.C. §§119 & 365 related to U.S. Provisional Patent Application Ser. No. 61/392,452 filed by the Applicant on 12 Oct. 2010 entitled "An Acoustic Radiator Including A Combination Of A Co-Axial Audio Speaker And Passive Radiator." U.S. Provisional Patent Application Ser. No. 61/392,452 and related International Application PCT/US2011/055843 of the same title filed on Oct. 11, 2011, and published Apr. 19, 2012 as International Publication Number WO 2012/051217 A2. Each application is incorporated by reference in its entirety into this application.

BACKGROUND OF THE INVENTION

1. Field of the Invention

This invention relates to an acoustic radiator that includes an audio speaker and passive radiator mounted in the same enclosure, particularly they are mounted coaxially with the audio speaker surrounded by a passive radiator flexibly mounted in an enclosure.

2. Description of the Related Art

The mounting of an audio speaker and a passive radiator in the same enclosure with substantially trapped air within the enclosure is not a new concept. Two examples of the prior art is illustrated and discussed in a patent by Michael Klasco in U.S. Pat. No. 4,207,963 issued Jun. 17, 1980 and in a patent by Guido O. M. D'Hoogh in U.S. Pat. No. 5,892,184 issued Apr. 6, 1999.

In D'Hoogh's FIG. 3 and the accompanying description he states it is a bass-reflex system which accommodates a passive radiator electrodynamic loudspeaker in a rigid enclosure that has a first opening through which the passive radiator extends and a second opening in which the outer edge of the frame of his loudspeaker is mounted with the majority of the frame of the loudspeaker extending into the enclosure with the motor and cone mounted in a typical fashion in the interior of the frame substantially within the enclosure.

In D'Hoogh the loudspeaker frame is rigidly mounted to the enclosure thus when the loudspeaker is activated the frame and the enclosed mass of the motor magnet does not move relative to the enclosure therefore it does not influence the tuning frequency of the passive radiator.

FIGS. 1A and 1B illustrate, in a simplified format, the prior art audio speaker/passive radiator of D'Hoogh.

In FIG. 1A, a vertical cross-sectional slice has been taken through enclosure 1 having in the top of enclosure 1 a first opening 3 and a second opening 5. Mounted within first opening 3 is a typical audio speaker 7 having a frame 9 with a top outward extending lip 11 mounted rigidly to the top exterior surface of enclosure 1 surrounding opening 3 with the diameter of opening 3 and the diameter of frame 9 below lip 11 being substantially equal with the bulk of frame 9 extending into the interior of enclosure 1. Also shown is a representative vent 10 of a plurality of vents spaced around frame 9 below cone 15. In the bottom of frame 9 there is a typical electromagnetic speaker motor 13 with top and bottom plates with a permanent magnet sandwiched therebetween with the bottom of a speaker cone 15 attached to a voice coil bobbin in communication with the magnet of motor 13 having a dust cap 13' closing the center of motor 13 plus a spider 14 attached between the bottom of cone 15 and the interior of frame 9. The top edge of cone 15 is attached to lip 11 with a first surround 19. In second opening 5 there is mounted a solid passive radiator panel 21 by means of a second surround 23 between the top edge of passive radiator panel 21 and the top exterior surface of enclosure 1 around the edge of second opening 5. Via vents 10, the air in the space beneath cone 15 and dust cap 13' and within motor 13 is free to flow throughout the interior of enclosure 1. The interior of enclosure 1 in this configuration is substantially air tight thus when speaker 7 is activated the air pressure within enclosure 1 varies with the movement of speaker cone 15 thus causing passive radiator panel 21 to move inward when cone 15 moves outward and outward when cone 15 moves inward in response to the variation of the interior air pressure of enclosure 1 resulting from movement of cone 15 given a selected time delay.

Since frame 9 of speaker 7 is mounted rigidly to the surface of enclosure 1, there is no movement of frame 9 and the magnet of motor 13 therewithin thus the only influence that causes movement of passive radiator panel 21 and second surround 23 is the movement of air created solely by the movement of speaker cone 15 and first surround 19.

FIG. 1B is a top view of the prior art audio speaker/passive radiator shown in FIG. 1A with audio speaker 7 and passive radiator 21 in place.

SUMMARY OF THE INVENTION

The acoustic radiator of the present invention provides a compact audio speaker/passive radiator in a coaxial structure. In each of the examples of the present invention there is a fully assembled audio speaker flexibly suspended in an enclosure with the flexible suspension connected between the audio speaker and the opening of the enclosure. In this configuration the audio speaker never comes into direct contact with any portion of the enclosure when energized or unenergized. In such configuration, the audio speaker functions as the audio speaker of the acoustic radiator. The passive radiator function of the acoustic radiator includes both the complete audio speaker and the flexible suspension between the audio speaker and the enclosure. In this configuration the audio speaker is a central portion of the passive radiator and thus it can be seen that the audio speaker and the passive radiator are effectively coaxially mounted one with the other.

Given the coaxial arrangement of audio speaker and passive radiator of the present invention, the enclosure in which the acoustic radiator can be mounted can be considerably smaller than that required for a speaker/passive radiator combination of the prior art. In automotive applications the present invention allows for the mounting of a tuned acoustic radiator in small cavities such as the dash board, door panels, seat backs, etc.

For example, currently car companies mount their speakers in a rigid fashion to the dashboard, on a rigid part that does not oscillate. In view of the current invention they could take a large portion of the dashboard around their speaker and separate it from the rest of the dashboard using a flexible membrane. This would improve the low frequency response as the new added surface area around the speaker will contribute more sound and since the suspended part of the dashboard+ speaker weight is larger than the speaker weight by its self, their tuning frequency will be lower.

Home, office, store and theater applications would also allow the use of a larger speaker/passive radiator combination of the present invention in enclosures having the same internal volume as currently used by prior art audio speaker/passive radiator combinations, in current audio speakers only enclosures or in wall and ceiling cavities, perhaps even inside doors, seat backs, desks, tables, computers, monitors, TV sets, etc. The acoustic radiator of the present invention also makes it possible for its inclusion in smaller devices and portable devices, e.g., notebook computers, cell phones, mp3 players, the base of lamps, etc.

Another application of the present invention is to build a standard enclosure with multiple interconnected rigid walls with at least one of the walls or a portion of a wall, a panel suspended in place with flexible seals all around that fasten it to the rest of the enclosure while allowing the panel to oscillate or vibrate. The panel alone in this example is a passive radiator or at least a portion of a passive radiator of the acoustic radiator. An active oscillator (e.g., audio speaker or tactile transducer) could be mounted on either side of the panel (interior or exterior) using a second suspension making the combination of the panel and active oscillator an acoustic radiator.

When the active oscillator is an active speaker, the speaker is flexibly coaxially mounted in a hole in the panel. When a signal is applied to the active speaker the motion of the speaker cone causes the enclosure internal pressure to oscillate applying a force to the panel that pushes and/or pulls the flexibly mounted panel either into or away from the rest of the enclosure causing the panel to oscillate as well. The moving mass of the oscillating components (active speaker and/or panel) can be increased or decreased and/or the stiffness of the flexible seals could be changed from a tight or soft suspension to change the natural frequency of the passive radiator (i.e., the combination of the speaker and panel in this configuration). If all variables were fixed [first variable: speaker piston (cone and surround) area; second variable: the total moving mass of the active speaker and the passive moving part; and third variable: the compliance of the suspension [Note that fixing these variables means the weight, the size of the passive element and the suspension stiffness], simply adding mass or weight to the speaker of the passive element will tune the passive radiator to have a lower resonance frequency ($W_n$). During oscillation, the active speaker moving mass stores kinetic energy that is equal to $E_k=\frac{1}{2}MV^2$, where M is the mass of the active speaker and V is its velocity, since the present invention has the active speaker suspended coaxially in the passive portion of the acoustic radiator, the kinetic energy stored in the moving mass of the active speaker is converted into vibrating the passive elements. Therefore the passive portion has two forces acting on it: one force is the indirect force due to the charging and discharging of the air spring within the enclosure; and the second force is the kinetic energy created by the active speaker which is directly coupled to the combined passive elements.

The D'Hoogh, Klasco, and Bose designs do not benefit from the transfer of kinetic energy from the speaker to the passive radiator. The prior art designs each only depend upon the charging and discharging of the air spring by the speaker cone in the enclosure to drive the passive element.

In the event that the desired application only requires a tactile transducer (e.g., a vibrator or some other impact device) attached to the inner or outer surface of the panel using the second suspension without a hole in the panel, then the driving energy of the panel tactile transducer combination is the kinetic energy alone.

DETAILED DESCRIPTION OF THE PRESENT INVENTION

Figure 2A:
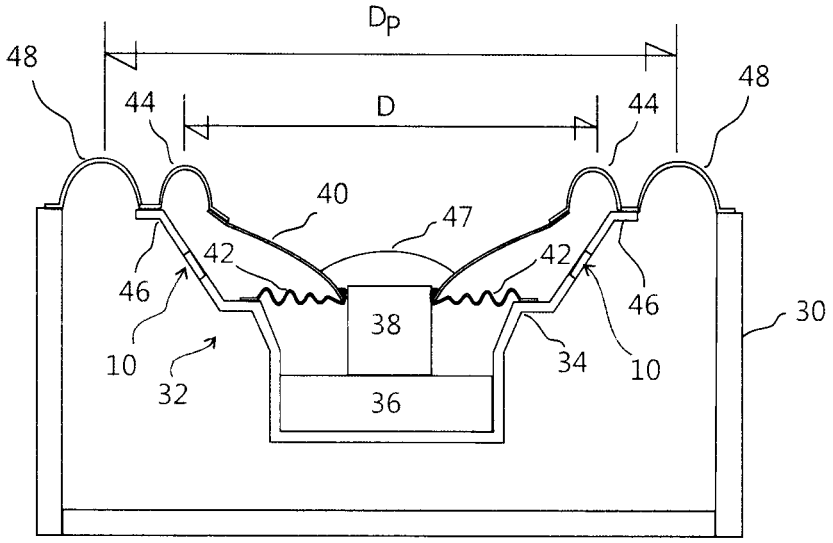
FIG. 2A is a vertical cross-sectional slice of a side view of a simplified view of a first example of a coaxial acoustic radiator of the present invention in an enclosure.
Figure 2B:
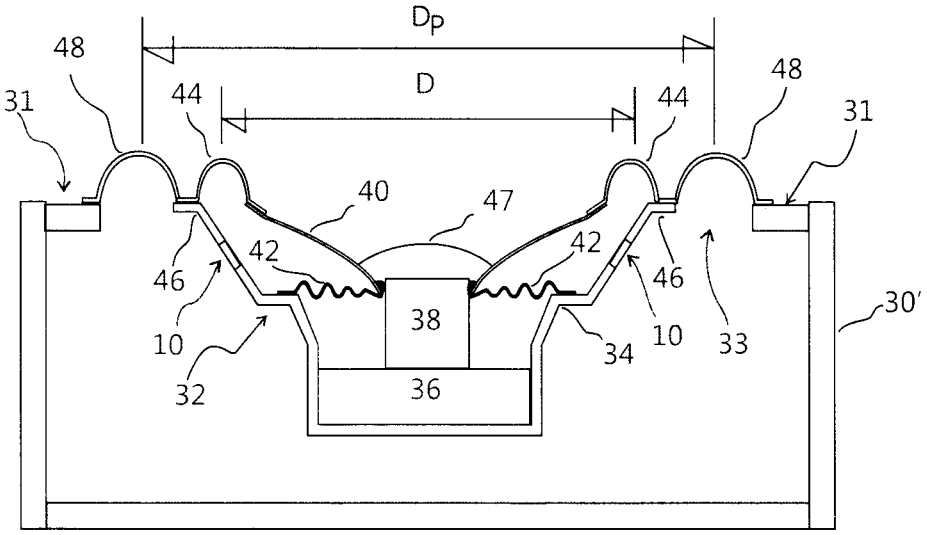
FIG. 2B is a vertical cross-sectional slice of a side view of a simplified view of a modified first example of a coaxial acoustic radiator of the present invention in an enclosure that has a partial top surface with a hole therein for receiving the speaker/passive radiator.

A first example of a coaxial acoustic radiator of the present invention is illustrated in FIGS. 2A and 2B. FIG. 2A shows a vertical cross-sectional slice of a side view of an acoustic radiator consisting of a coaxially mounted audio speaker/passive radiator combination in an enclosure with FIG. 2B showing a similar arrangement in an enclosure that has a partial top surface. While in vertical cross-section of the enclosures in FIGS. 2A and 2B are rectilinear, in horizontal cross-section they could be any shape, rectangular, circular, oval or any other desired shape that could include various shape features. In fact in vertical cross-section they could also be an desired shape, rectilinear as shown, spherical, oval or any desired shape that could include various shape features.

Figure 17:
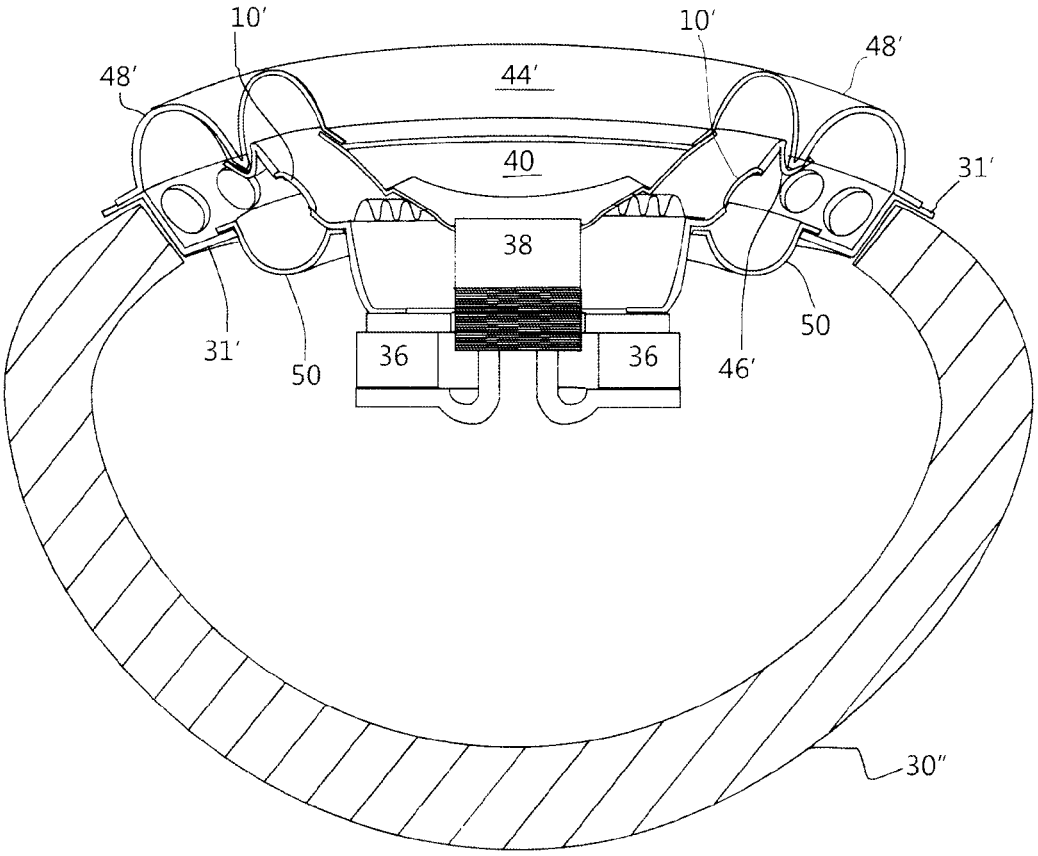
FIG. 17 This is a horizontal cross-section of a speaker/passive radiator coaxially mounted on a curved or spherically shaped surface of an enclosure.

Furthermore, the shape of the speaker opening can be any desired shape (e.g., round oval or any other desired shape) and the opening of the frame of the speaker could be shaped to match the surface of the opening into which the acoustic radiator of the present invention is to be mounted (e.g., a round pillar, a convex or concave shaped wall or even a surface that has a different horizontal radius of curvature from the vertical radius of curvature as will be come clear from the embodiment of the invention illustrated in FIG. 17) to match the décor where placed or to enhance performance (e.g., focus the radiation or to broaden the angle of radiation from the acoustic radiator of the present invention.

It should be noted that the comments above with respect to the speaker and enclosure shapes is also true for various other embodiments of the coaxial acoustic radiator of the present invention.

In FIG. 2A there is shown an enclosure 30 having a bottom portion and a vertically upward extending side portion with an open top. Centered in the open top of enclosure 30 and extending into enclosure 30 there is a fully functional typical audio speaker 32 with the top most portion of speaker 32 being substantially even with, and spaced apart from, the top edge of the side portion of enclosure 30. Speaker 32 has a frame 34 with motor 36 mounted within the bottom of frame 34 that includes a voice coil bobbin 38 that extends partially upward out of the main body of motor 36. Attached near the top of, and encircling, bobbin 38 is a centering spider 42 attached between bobbin 38 and an inside point of frame 34 with the bottom edge of a speaker cone 40 also attached near the top of, and encircling, bobbin 38 a representative typical vent 10 which is typically spaced around frame 34 below speaker cone 40 is shown. The top, or outer rim, of speaker cone 40 has encircling, and attached thereto, an inner flange of a flexible surround 44 with the outer flange of flexible surround 44 attached to the upper horizontally outward extending lip 46 of frame 34 thus completing the assembly of speaker 32. In turn fully assembled speaker 32 is suspended within enclosure 30 solely with a flexible membrane 48, which for convenience is shown in this view as a second surround that is attached between lip 46 of frame 34 and the top edge of the vertically extending side portion of enclosure 30.

Note that speaker 32 is suspended in a position within enclosure 30 so that at no time does any portion of speaker 32, whether powered or unpowered, come into direct contact with enclosure 30. This feature is a key element and will be seen in each example of the present invention discussed herein. In this arrangement, the entire front of the enclosure to which the acoustic radiator is mounted can radiate acoustic energy.

In FIG. 2B the structure is the same as that of FIG. 2A with one modification. Enclosure 30' in FIG. 2B includes a partial enclosure top cover 31 having an opening 33 therein that is shaped and sized to accept the fully assembled speaker 32 with one end of flexible membrane 48 attached to lip 46 of speaker 32 as in FIG. 2A however, the second end of flexible membrane 48 is attached to the closest end of the top of partial enclosure top cover 31 instead of directly on the top edge of the vertical side of the enclosure as in FIG. 2A. Thus it can be seen that speaker 32 is freely suspended and not firmly mounted to enclosure 30 or top cover 31.

Given the configurations shown in each of FIGS. 2A and 2B, the active speaker dimension, D, is from the center of flexible surround 44 on either side of speaker 32 whereas the active passive radiator dimension, $D_P$, is from the center of the flexible membrane 48 surrounding speaker lip 46 across speaker 32. Thus it can be seen that the coaxial arrangement of speaker 32 and flexible membrane 48 includes the entire speaker 32 as part of the passive radiator together with half of flexible membrane 48 in each of FIGS. 2A and 2B.

Figure 2C:
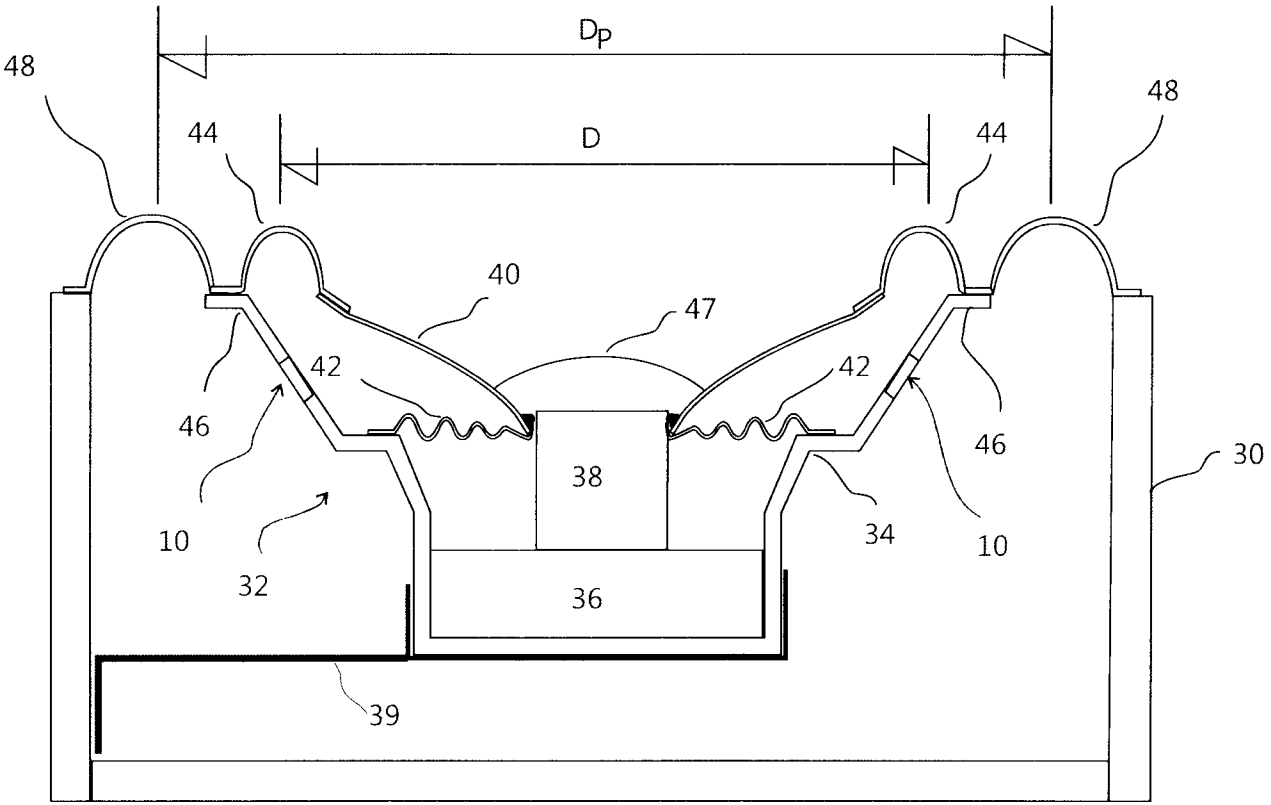
FIG. 2C shows the acoustic radiator of FIG. 2A with an added flexible element to reduce sagging of the speaker.

FIG. 2C shows an arrangement that is identical to that of 2A. In FIG. 2C the weight of the speaker is suspended by a flexible element 39 above the bottom of enclosure 30 a sufficient distance to not restrict axial movement of the speaker and prevents it from bottoming out within enclosure 30. Flexible element 39, in this view, is shown anchored to both the bottom of the speaker and near the bottom of an inner side of enclosure 30. To determine the position and spring constant of flexible element 39 the spring constant of the speaker surround, the weight of the moving mass of the speaker and the frequency range of the speaker, to optimize resonance frequencies for the active and the passive operation all need to be taken into consideration. Depending of the materials used, flexible element 39 could incorporate one or more elements.

If more than one flexible element is used, the designer could use elements that actually suspend the weight from various points or at a intermediate point this offers a swing like suspension. In limited, low power applications, alternatively the passive radiator surround 48 compliance could be softened making sure that the weight of the speaker does not force the surround to buckle which would render the acoustic radiator useless.

There are many ways that a more complex supporting element could be designed, e.g., employ a fluid filed device similar to shock absorber, a complex spring arrangement, rubber bands, other flexible material.

Figure 2D:
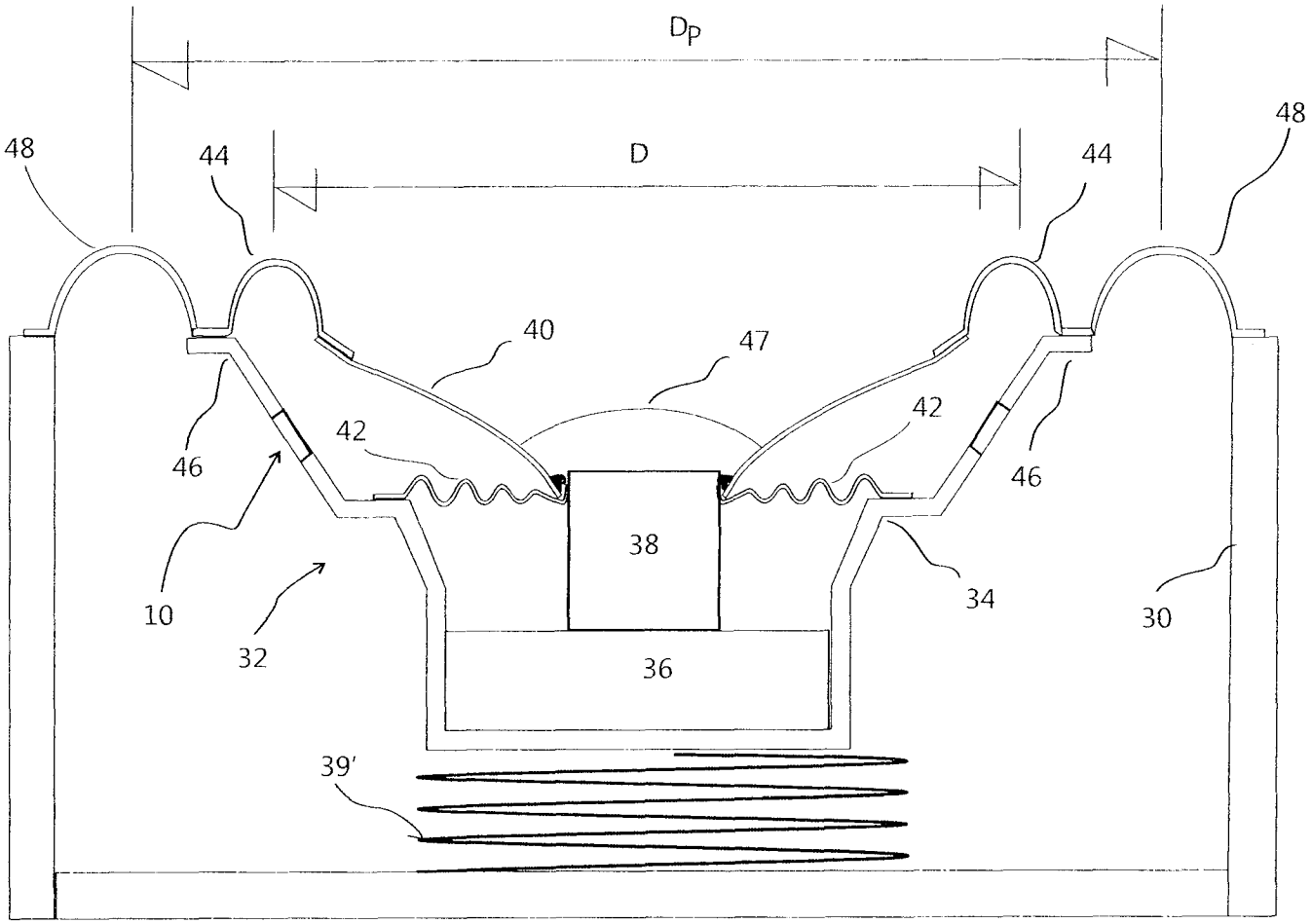
FIG. 2D shows the acoustic radiator of FIG. 2A with an added spring below the speaker to reduce sagging of the speaker.

FIG. 2D shows a mechanical means that help in keeping the speaker from compromising the suspension of the passive elements, particularly surround 48 or its equivalent. FIG. 2D shows spring 39' placed beneath speaker 32 and fixed to the bottom of the enclosure 30. As the passive elements get into maximum excursion, spring 39' will retain the motion in an axial direction and will reduce the wobble of the speaker.

An alternative to the embodiments shown in FIGS. 2C and 2D, a spider (similar to spider 42) could be fasten horizontally around the magnet 36 end of speaker 32 and extend it to, and connect it to, the inner side wall of enclosure 30. This would provide a low cost solution. If needed multiple spiders could be employed. While the main focus of the present invention is not about reducing the wobble of the speaker, they are novel embodiments which many be needed in some applications of the present invention.

Figure 3A:
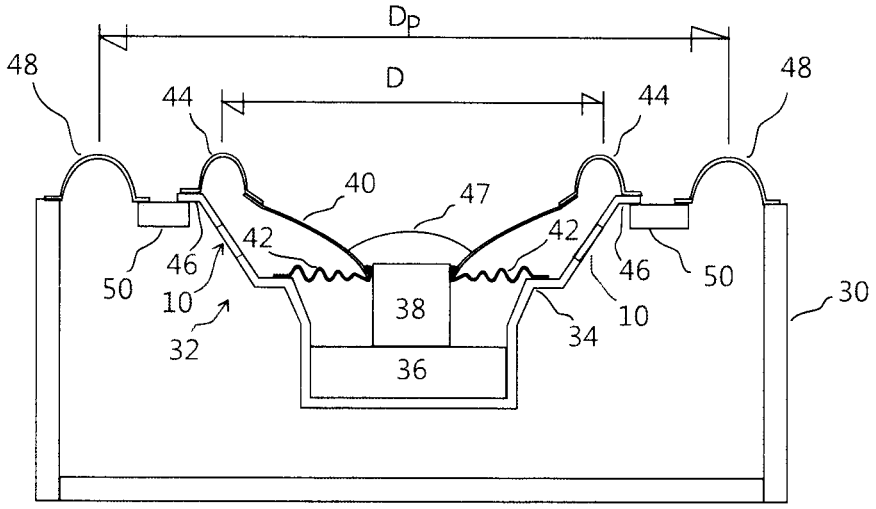
FIG. 3A is a vertical cross-sectional slice of a side view of a simplified view of a second example of a coaxial acoustic radiator in an enclosure.
Figure 3B:
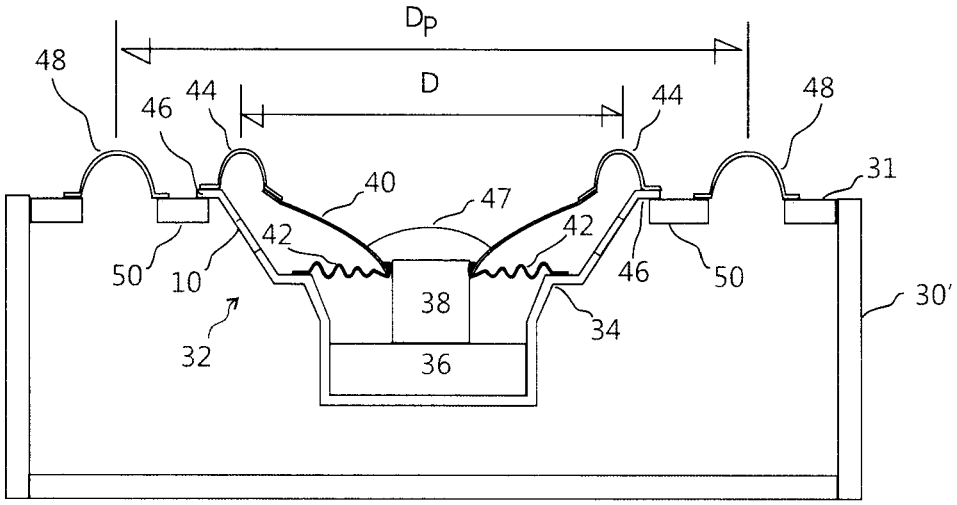
FIG. 3B is a vertical cross-sectional slice of a side view of a simplified view of a second example of an acoustic radiator in an enclosure.

A second example of a coaxial acoustic radiator is illustrated in FIGS. 3A and 3B, each of which is a modified version of that shown in FIGS. 2A and 2B, respectfully. Each of these examples include all of the same components as in the corresponding first example with one added component. Each of FIGS. 3A and 3B include a non-flexible ring 50 between speaker 32 and flexible membrane 48. In this configuration, speaker lip 46 is mounted on an inner edge of ring 50 and an inner portion of flexible membrane 48 is connected to an outer edge of ring 50 instead of to lip 46 of speaker 32 as in the first example shown in FIGS. 2A and 2B.

Given the configurations shown in each of FIGS. 3A and 3B, the active speaker dimension, D, is from the center of flexible surround 44 on either side of speaker 32 as is the case in the first example in FIGS. 2A and 2B. However, in the configuration of FIGS. 3A and 3B the active passive radiator dimension, $D_p$, still extends between the center of the flexible membrane 48 on either side of enclosure 30 or 30' however it also includes twice the width of non-flexible ring 50 which was not included in FIGS. 2A and 2B.

Figure 4A:
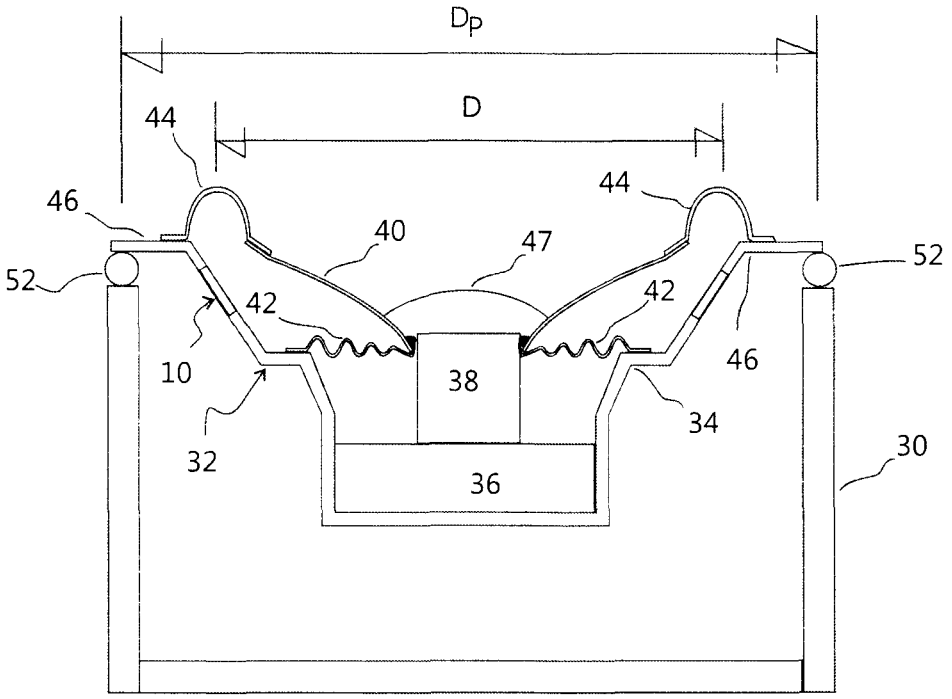
FIG. 4A is a vertical cross-sectional slice of a side view of a simplified view of a third example of an acoustic radiator in an enclosure.
Figure 4B:
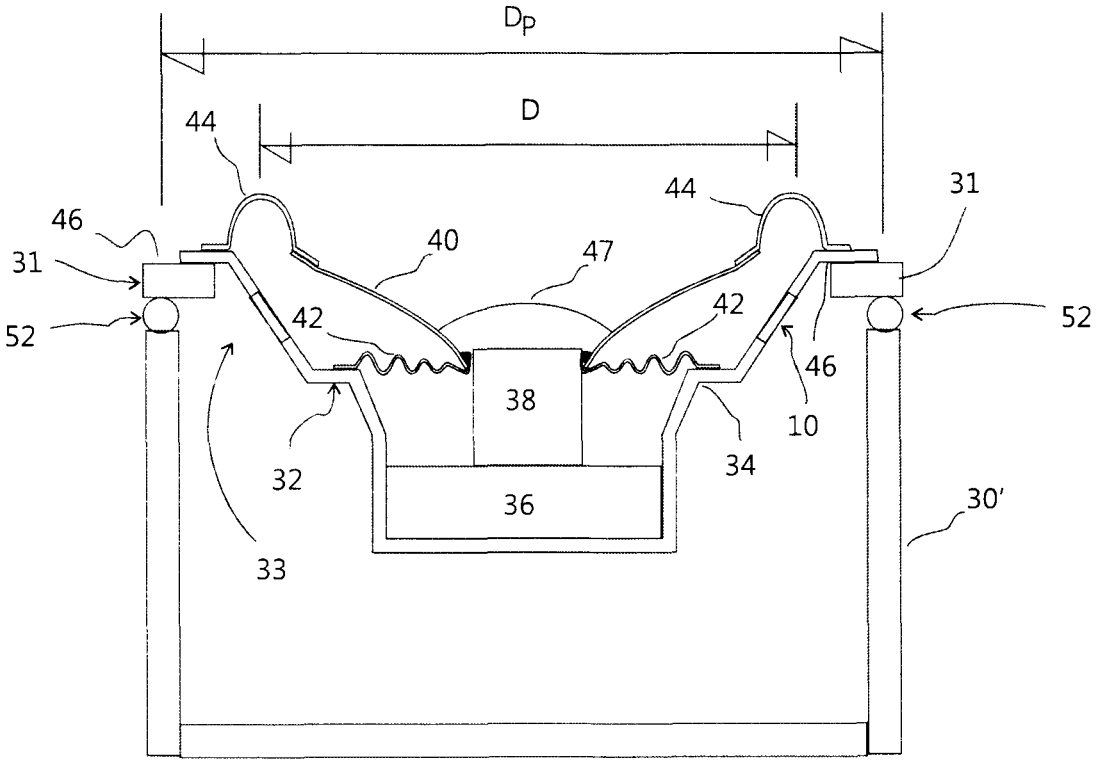
FIG. 4B is a vertical cross-sectional slice of a side view of a simplified view of a third example of an acoustic radiator in an enclosure.

A third example of a coaxial acoustic radiator is illustrated in FIGS. 4A and 4B. The third example shown in FIGS. 4A and 4B is somewhat different than the first and second examples discussed above. As in the previous examples, each of FIGS. 4A and 4B includes a speaker 32 as previously described however the speaker to enclosure mounting is different.

In FIG. 4A, attached to the top edge of enclosure 30, there is a resilient member 52 with lip 46 of speaker 32 mounted on top of resilient member 52 with speaker frame 34 extending into enclosure 30.

In FIG. 4B enclosure 30' includes a partial enclosure top cover 31, as in FIG. 2B, mounted on resilient member 52 that is attached to the top edge of enclosure 30' with lip 46 of speaker 32 mounted to a partial enclosure top cover 31 with frame 34 extending through hole 33 in cover 31 with the underside of outer edge of cover 31 mounted on resilient member 52 that is on the top edge of enclosure 30'.

Given the configurations shown in each of FIGS. 4A and 4B, the active speaker dimension, D, is from the center of flexible surround 44 on either side of speaker 32 as is the case in the first and second examples. Whereas the active passive radiator dimension, $D_p$, is from the center of the resilient member 52 on either side of enclosure 30 or 30'.

In any of the configurations of the examples illustrated in FIGS. 2A through 4B, the speaker can have any desired shape, round, oval, etc. For purposes of illustration of the effective working areas of the active speaker and passive radiator of each of those examples if speaker 32 is assumed to be round with the working area of the speaker being:

$$\text{Active speaker working area}=\pi D^2/4 \quad (1)$$

for a cylindrical enclosure 30 of FIGS. 2A, 3A and 4A the passive speaker working area is:

$$\text{acoustic radiator working area}=\pi D_P^2/4 \quad (2)$$

and for a rectilinear enclosure 30' of FIGS. 2B, 3B and 4B that is assumed to be square for this calculation, the passive speaker working area is:

$$\text{acoustic radiator working area}=D_P^2 \quad (3)$$

Similar calculations can be made for various speaker and enclosure shape combinations.

Note, that in each of the configurations illustrated in FIGS. 2A-4B speaker 32 has been shown extending into the enclosure, speaker 32 could alternatively be inverted and mounted to extend outside of the enclosure.

As can be seen from each of these formulas, the Passive Speaker Working Area in every situation is larger than the Active Speaker Working Area since the passive radiator includes the entire active element in addition to the surround since the two are coaxially mounted.

Additionally, in the examples of FIGS. 2A-2B, for any coaxial configuration, the passive moving mass can be approximated as the sum of the weight of the active speaker 32, the weight of flexible membrane 48 and the air load within the enclosure.

For the examples of FIGS. 3A-3B, for any coaxial configuration, the passive moving mass can be approximated as the sum of the weight of the active speaker 32, the weight of non-flexible ring 50, the weight of flexible membrane 48 and the air load within the enclosure.

For the example of FIG. 4A, for any coaxial configuration, the passive moving mass can be approximated as the sum of the weight of the active speaker 32 and the air load within the enclosure.

And for the example of FIG. 4B, for any coaxial configuration, the passive moving mass can be approximated as the sum of the weight of the active speaker 32, the weight of non-flexible ring 50, the weight of enclosure top cover 31 and the air load within the enclosure.

In any coaxial speaker/passive radiator configuration the passive tuning frequency can be selected to be lower than the active resonance frequency of the active speaker. More over, the weight of the active speaker 32 and the stiffness of flexible membrane 48 can be selected and matched to provide the desired tuning frequency.

Figure 5A:
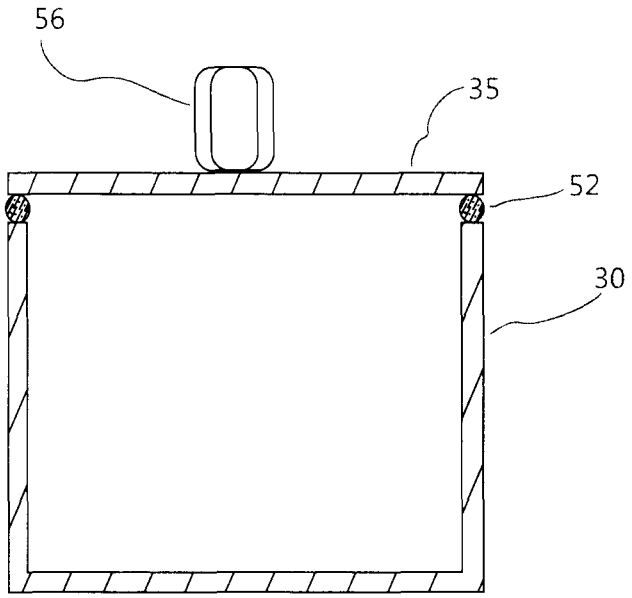
FIG. 5A is a vertical cross-sectional slice of a side view of a simplified view of a fourth example of an acoustic radiator.
Figure 5B:
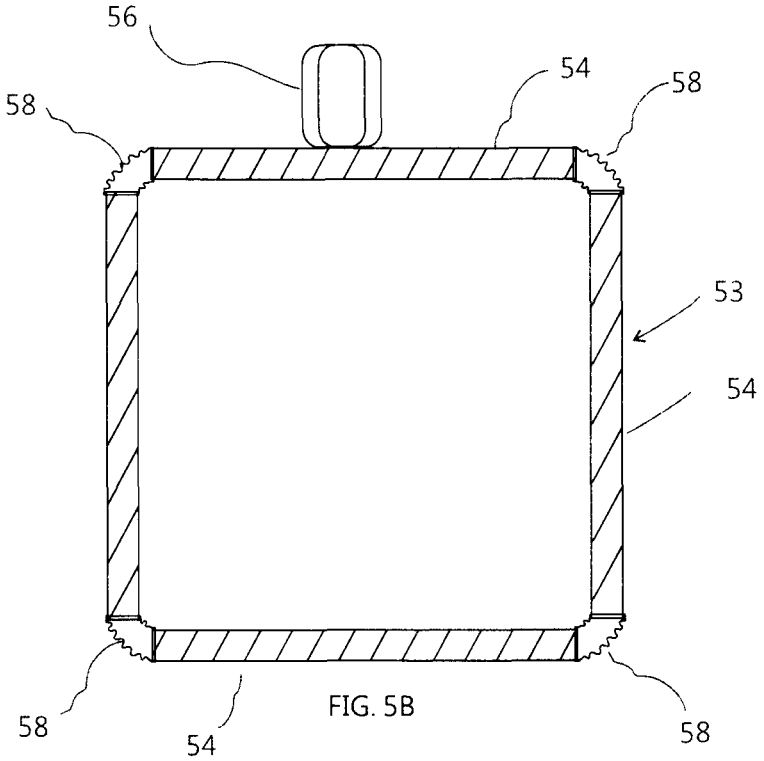
FIG. 5B is a vertical cross-sectional slice of a side view of a simplified view of an alternative fourth example of an acoustic radiator.

FIGS. 5A and 5B illustrate examples of an acoustic radiator that uses a tactile transducer 56, instead of a audio speaker, to energize a passive radiator panel.

FIG. 5A is a vertical cross-sectional slice of a side view of a simplified view of a fourth example of an acoustic radiator in a rigid enclosure 30 with resilient member 52 on the top edge of the sides of enclosure 30 as in either FIG. 4A or 4B with a top cover 35 resting on resilient member 52 completely closing enclosure 30. Substantially centrally mounted on the outside of top cover 35 is a vibrating element 56. Alternatively, vibrating element 56 could be mounted inside enclosure 30 centrally mounted on the under side of top cover 35. Vibrating element 56 can be any desired device that could impart a controlled vibrational pattern to top cover 35, e.g., an audio speaker, woofer, or other type of vibrator.

FIG. 5B is a vertical cross-sectional slice of a side view of a simplified view of an alternative fourth example of an acoustic radiator having an enclosure including separate rigid panels 54 making up each side thereof with flexible joining element 58 interconnecting the adjacent panels 54, running the full-length of each of the adjacent panels 54. At the corners of enclosure 53 where a panel 54 parallel to the surface of FIG. 5B that closes the opening shown in the figure, the flexible joining elements 58 mate with the other flexible elements 58 to close the three dimensional corner of enclosure 53.

In FIG. 5B, as in FIG. 5A, substantially centrally mounted on the outside of panel 54 shown at the top of enclosure 53 is a vibrating element 56 which could alternatively be mounted on the under side of that panel inside enclosure 53. As shown in FIG. 5B each of the panels 54 is mounted to the adjacent panels 54 on all four edges with flexible elements 58. That being the case, vibrating element 56 could be mounted on any of the panels 54 that make up enclosure 53. Additionally, depending on the intended application, a vibrating element could be similarly mounted on more than one of panels 54.

Figure 6:
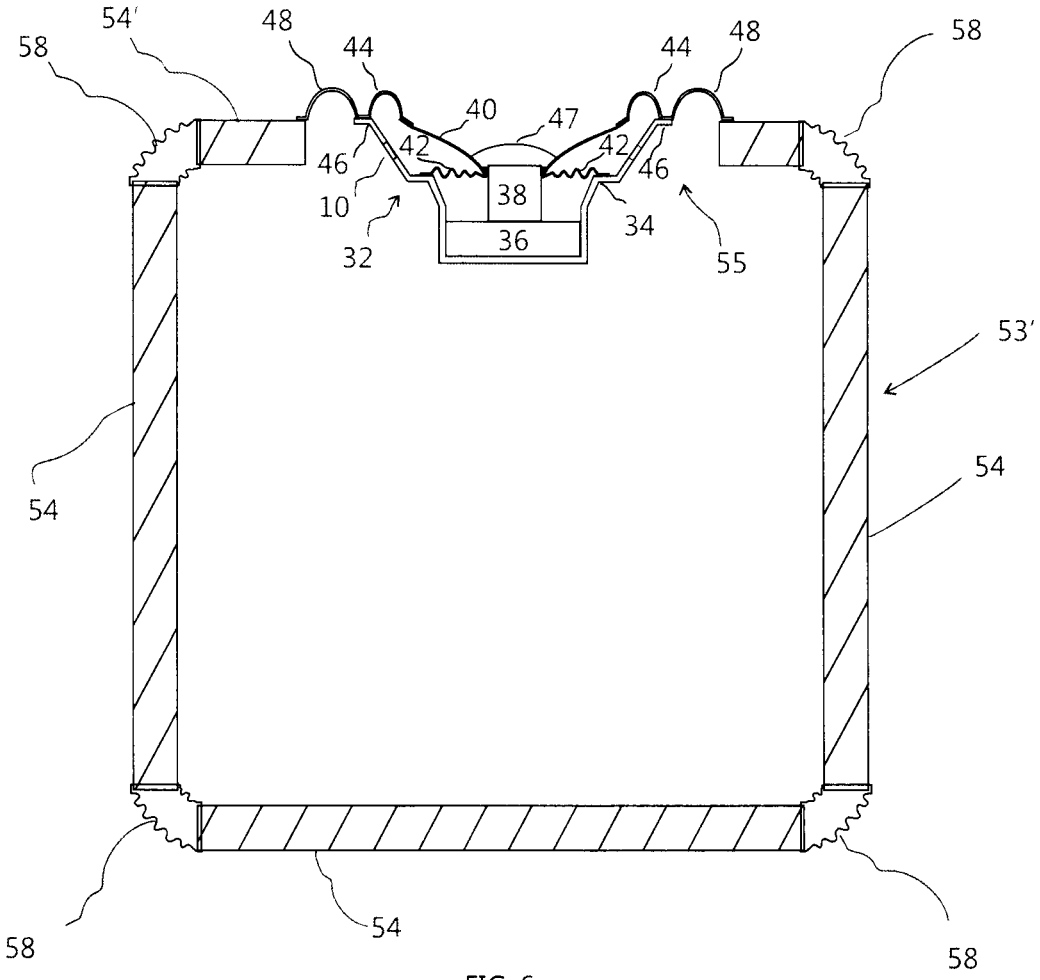
FIG. 6 is a vertical cross-sectional slice of a side view of a simplified view of a fifth example of a coaxial acoustic radiator that is similar to the modified first example of FIG. 2B in an enclosure of the alternative fourth example.

FIG. 6 is a vertical cross-sectional slice of a side view of a simplified view of a fifth example of an acoustic radiator that is similar to the first example shown in FIG. 2A in an enclosure similar to that of the alternative fourth example of FIG. 5B. In the example of FIG. 6 enclosure 53' includes a modified panel 54' in the top that has a center hole 55 therein to receive a fully functional audio speaker 32 as described above in relation to FIG. 2A. In turn fully assembled speaker 32 is suspended in hole 55 of panel 54' solely with a flexible membrane 48, which for convenience is shown in this view as a second surround that is attached between lip 46 of frame 34 and the top edge of panel 54' outside of hole 55 with the combination of speaker 32 and flexible membrane 48 closing hole 55.

Note that speaker 32, whether powered or unpowered, is suspended in a position within enclosure 53' so that at no time does any portion of speaker 32 come into direct contact with any of panels 54 and 54' or flexible joining elements 58 of enclosure 53'.

Note that in each of the examples in FIGS. 2A-6 discussed above the oscillating element (i.e., speaker or vibrating element) can be mounted to extend into, or out of, the enclosure.

Figure 7A:
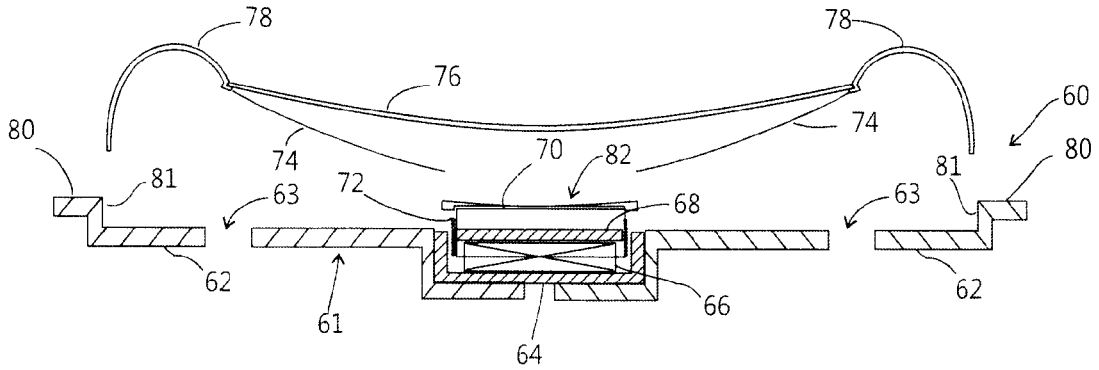
FIG. 7A is a vertical cross-sectional slice of the components of an exploded view of a flat frame speaker.

In FIG. 7A there is shown a vertical cross-sectional slice of an exploded view of a flat frame speaker 60. Frame 61 has defined therein a central region for receiving speaker motor 82 and extending horizontally outward substantially perpendicularly from the central region is frame side portion 62 with vent holes 63 therethrough spaced evenly around the central region in the full frame. Also shown in the bottom of the central region of frame 61 is a vent hole. The outer surrounding edge of side portion 62 of frame 61 includes a raised outer lip 80 defining a vertical surface 81.

Motor 82 includes a cup shaped bottom ferro-magnetic plate 64 into which there is a magnet 66 having a diameter that is smaller than the inner diameter of bottom plate 64. In the bottom of plate 64 there is a vent hole opposite the vent hole in the central region of frame 61. On top of magnet 66 there is top ferro-magnetic plate 68 having a diameter that is at least as large as the diameter of magnet 66 and substantially smaller than the inner diameter of bottom plate 64. Extending into the space between top plate 68 and the side of bottom plate 64 is bobbin 70 having a voice coil 72 wound externally around bobbin 70.

Figure 7B:
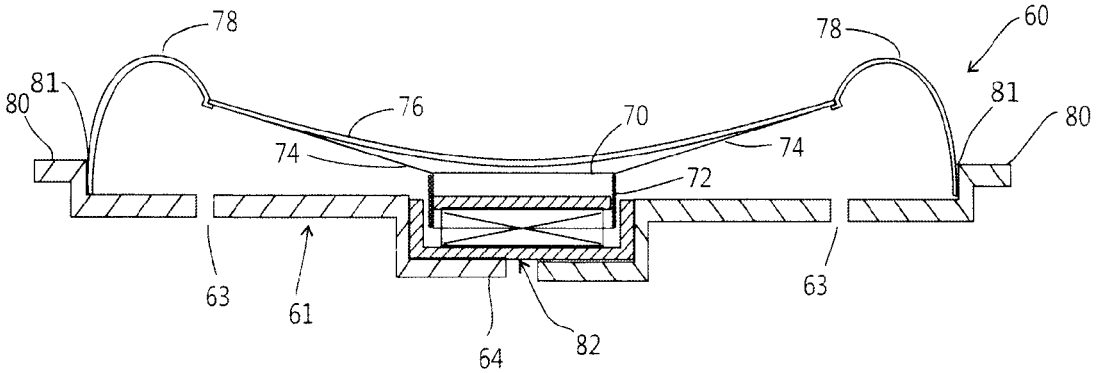
FIG. 7B is a vertical cross-sectional slice of the components of an assembled view of the flat frame speaker of FIG. 7A.

Above frame 61 and motor 82 is a rigid connection element 74 which will be discussed when FIG. 7B is addressed, and above rigid connection element 74 there is a speaker cone 76 with an inner end of surround 78 attached to the outer edge of speaker cone 76.

In FIG. 7B there is shown a vertical cross-sectional slice of fully assembled view of the flat frame speaker 60 of FIG. 7A. In this view the outer end of surround 78 is attached to vertical surface 81 of frame 61. Additionally, rigid connection element 74 has the inner end attached to the upper edge of bobbin 70 and the outer end attached to the bottom of cone 76 at or near the interconnection of cone 76 and surround 78.

When viewed perpendicularly to the top of flat speaker 60 of FIGS. 7A and 7B the overall shape of speaker 60 will typically be circular or oval, however other shapes could also be used.

Flat speaker 60 of FIGS. 7A and 7B can be mounted shallow spaces. Some examples would be in headphones, a small desk top speaker application or in a computer keyboard of either a desk top or notebook computer.

Figure 8A:
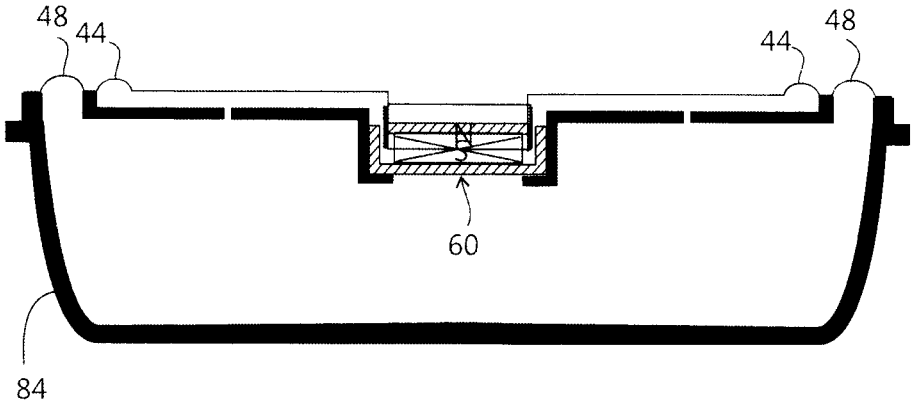
FIGS. 8A-C are three coaxial acoustic radiator variations using the flat frame speaker of FIGS. 7A and B in ear cups for a head set.

FIG. 8A illustrates a first example of a coaxial acoustic radiator in an ear cup 84 of a headset. In this view a flat frame speaker 60 of FIGS. 7A and B is suspended in the opening of ear cup 84 with a flexible membrane 48 as in the coaxial speaker-passive radiator of FIG. 2A.

Figure 8B:
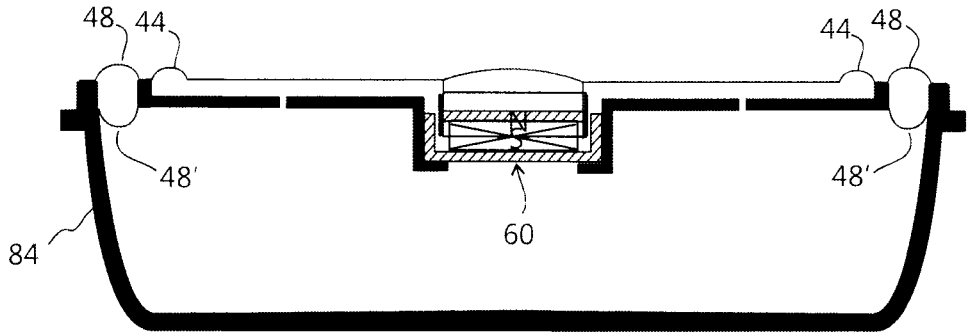

FIG. 8B illustrates a second example of a coaxial acoustic radiator in an ear cup 84 of a headset that is similar to that shown in FIG. 8A with a symmetrical flexible membrane 48-48' (one outward curved and one inward curved).

Figure 8C:
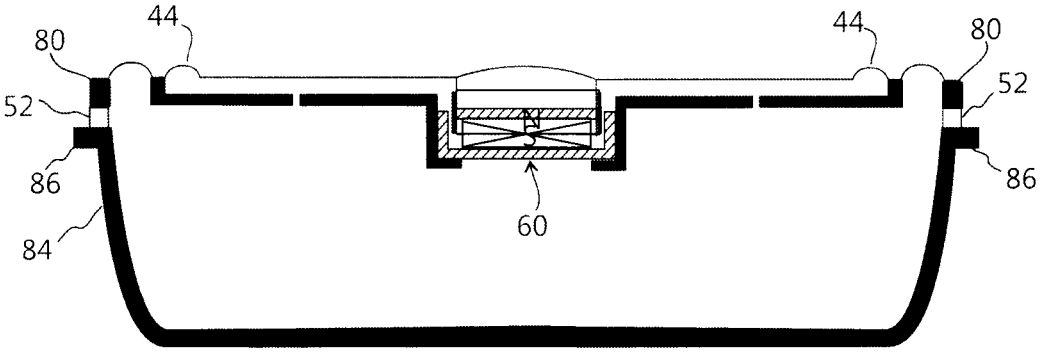

FIG. 8C illustrates third example of a coaxial acoustic radiator in an ear cup 84 of a headset. In this view a flat frame speaker 60 of FIGS. 7A and B is suspended in the opening of ear cup 84 with a resilient member 52 between the outer lip 80 of speaker 60 and an open edge of ear cup housing 84 as in the coaxial speaker-passive radiator of FIG. 4A.

Figure 9:
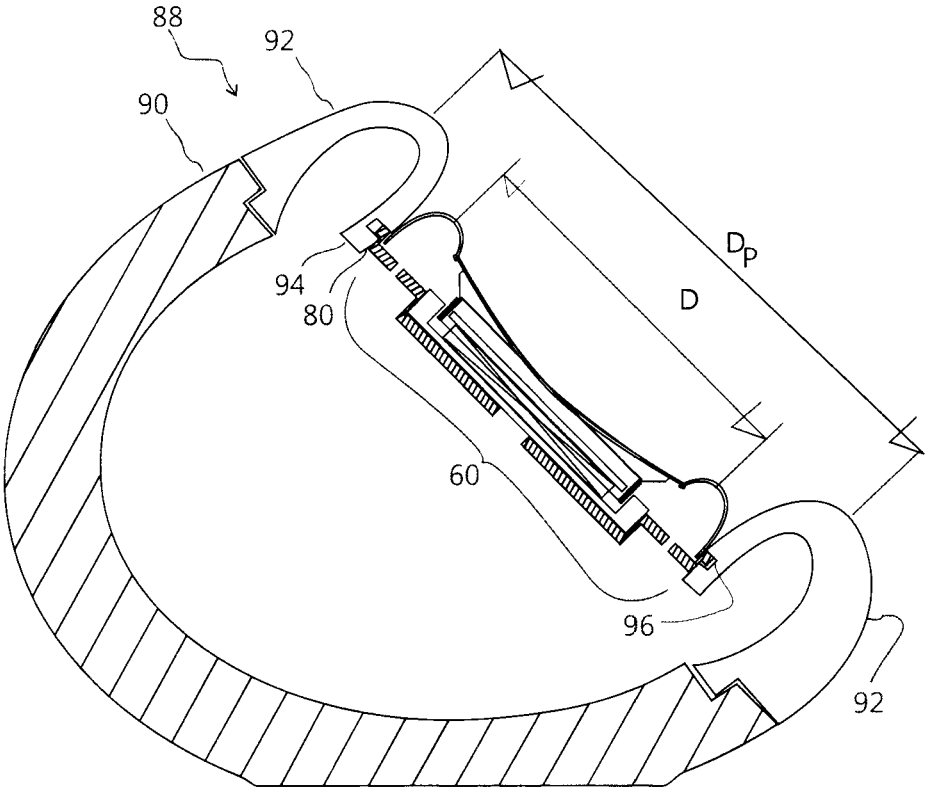
FIG. 9 is a cross-sectional view of an example of a small desktop coaxial acoustic radiator using the flat frame speaker of FIGS. 7A and B.

FIG. 9 is a cross-sectional view of an example of a small desktop coaxial acoustic radiator 88 using the flat frame speaker 60 of FIGS. 7A and B. Desktop housing 90 is shown with an opening selected to be is approximately 45° from horizontal however any desired angle from 0° to 90° could be used. Affixed to the opening of housing 90 is a U-shaped, or half-donut shaped, flexible membrane 92 with the inner leg 94 extending into the opening in housing 90. Adjacent the end of inner leg 94 there is a formed groove 96 sized and shaped to receive and retain the outer lip 80 of the frame of flat speaker 60. As in FIGS. 2A-4B the effective dimension D of the active speaker and the effective dimension $D_p$, of the active passive radiator are shown for the desktop acoustic radiator. If speaker 60 and the opening of desktop housing 90 are both circular then the active speaker working area and the passive speaker working area is as indicated in equations (1) and (2) above.

Figure 10A:
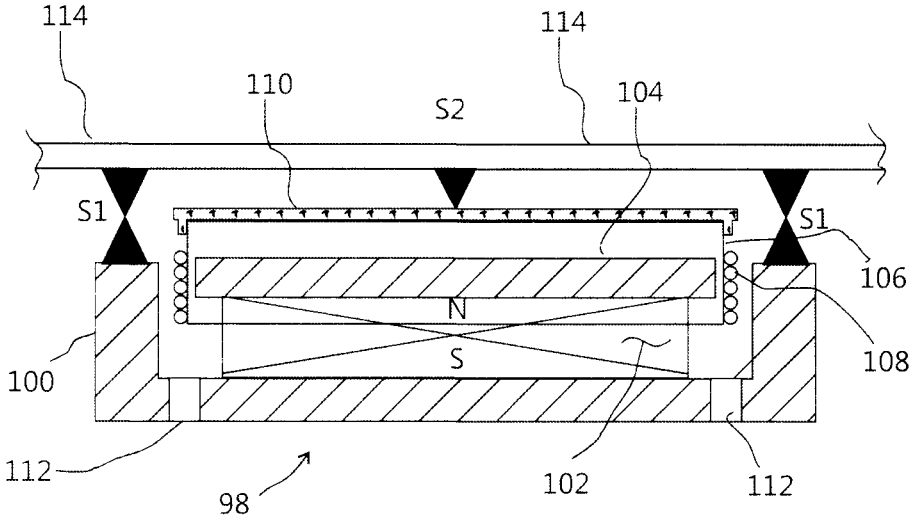
FIGS. 10A and B are each a partial cross-sectional view of an example of a coaxial acoustic radiator that includes a suspended electromagnetic motor from a radiating panel.

FIG. 10A is a partial cross-sectional view of an example of a coaxial acoustic radiator that includes a suspended electromagnetic motor 98 from a radiating panel 114. Motor 98 includes cup shaped bottom ferro-magnetic plate 100 with magnet 102 centered in plate 100 with a ferro-magnetic top plate 104 on magnet 102. Extending into the space between the raised side of bottom plate 100 and both magnet 102 and top plate 104 is bobbin 106 with voice coil 108 wound on the bottom end thereof. Affixed to the top end of bobbin 106 top cover 110 that closes the top of bobbin 106. Also shown through bottom plate 100 between magnet 102 and the upward extending side of bottom plate are air vent holes 112 that are evenly spaced around the bottom of bottom plate 100.

Also shown there are two suspensions, S1 and S2, to attach motor 98 to the underside of radiating panel 114. Suspension S1 has a lower end that is firmly attached to, and total encircles, the top edge of the raised side portion of bottom plate 100. The upper end of suspension S1 is firmly attached to the under side of radiating panel 114 encircling a similarly shaped region to the shape of the top edge of bottom plate 100. The bottom end of suspension S2 is attached substantially to the center of bobbin top cover 110 with the top end attached to the under side of radiating panel 114.

The rigidity or flexibility of material and cross-sectional shape of suspensions S1 and S2 is a matter of design choice. Those choices being largely influenced to allow sufficient space for bobbin 106 to move vertically in response to a signal applied to voice coil 108 and to prevent bottom plate 100 from bottoming out in what ever enclosure motor 98 is suspended within.

During operation the electro-magnetic motor expands and contracts as the signal applied to voice coil 108 changes. During outward motion of top cover 110, S1 is compressed (compression) and S2 is stretched (tension). During inward motion, the reverse is true. This relationship is referred to herein as push-pull suspension (S1, S2) bending in radiating panel 114.

In a push-pull suspension, the shape of the suspensions (S1, S2) is a matter of design choice to create the desired dampening response. If it is desired to be able to tune the push-pull response an air filed tube in which the air pressure can be varied, like a bicycle inner tube, with the air pressure varied to control the compliance of the suspensions. Other types of fluids could be use instead of air.

Figure 10B:
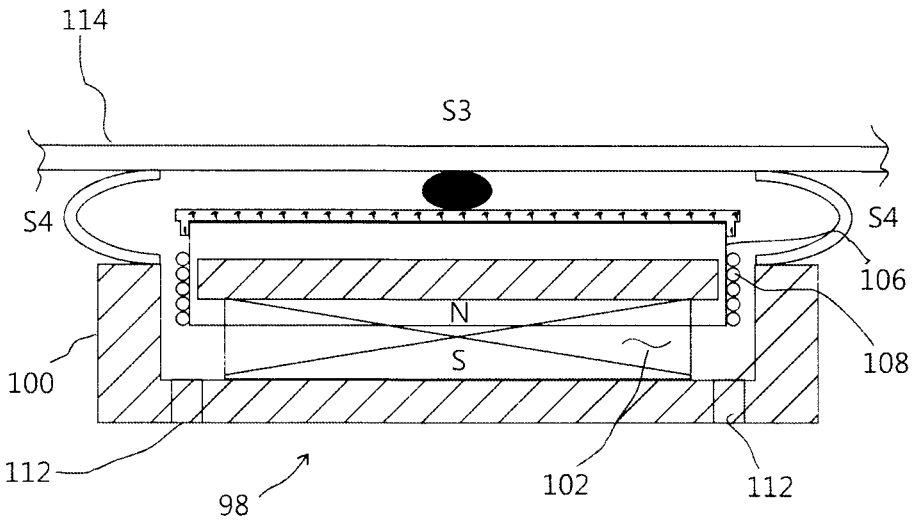

FIG. 10B is a modified example of the coaxial acoustic radiator shown in FIG. 10A. This example is the same as that of FIG. 10 with suspensions S1 and S2 replaced with suspensions S3 and S4, respectively. Suspension S3 is a semi rigid mass that could be made of a hard rubber or similar material that has a selected resilience, or perhaps a hard mass coated with a hard rubber or similar material that has the selected resilience. Suspension S4 is ring shaped with a "U" shaped vertical cross section that has a selected flexibility that act as a circular spring between the top edge of bottom plate 100 and the bottom of radiating panel 114.

A push-pull suspension system in a speaker removes the need to have a basket or frame to hold the speaker together. Unless properly constructed of appropriate materials push-pull systems might generate sounds when radiating panel 114 bends as in FIGS. 10A, 10B, 11A,11B,11C, and 11D.

FIGS. 11A-D illustrate an example application of the suspended electromagnetic motor acoustic radiator of FIG. 10 in a low height enclosure.

Figure 11A:
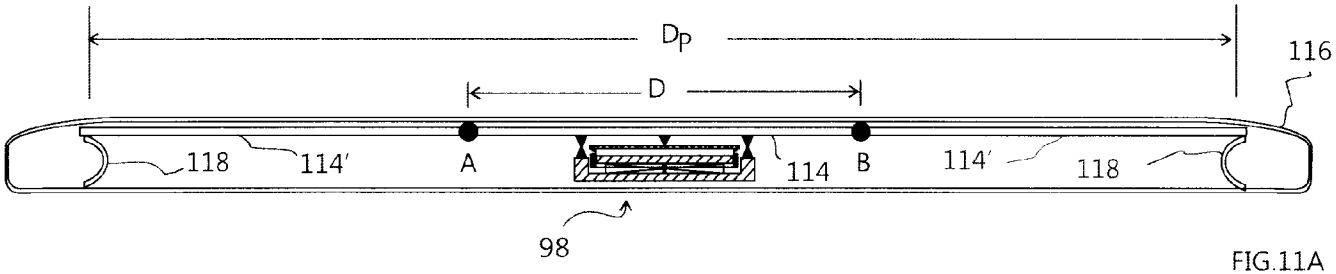
FIGS. 11A-D illustrate an example application of the suspended electromagnetic motor acoustic radiator of FIG. 10 in a low height enclosure.

FIG. 11A shows a cross sectional slice of a low height enclosure 116 (e.g., a computer keyboard, a notebook computer, etc.) with a suspended electromagnetic motor 98 suspended from panel 114 as in FIG. 10. Edges of panel 114 from which motor 98 is suspended have flexible seals A and B that connect to the inner edge of each of secondary panel portions 114'. The outer edge of secondary panel portions 114' in turn are supported within enclosure 116 with suspension 118. While not shown in FIG. 11A since it is a view of a cross sectional slice, suspension 118 also runs the full length of both sides of the panels 114' and 114. Enclosure 116 is deep enough, and suspension 118 is high and stiff enough to prevent suspended electromagnetic motor 98 from coming into contact with the interior of enclosure 116. Also, enclosure 116 has formed therein sound holes 117' (see FIG. 14B) in panel 114 to permit the sounds created by motor 98 to radiate outward from enclosure 116.

Figure 11B:
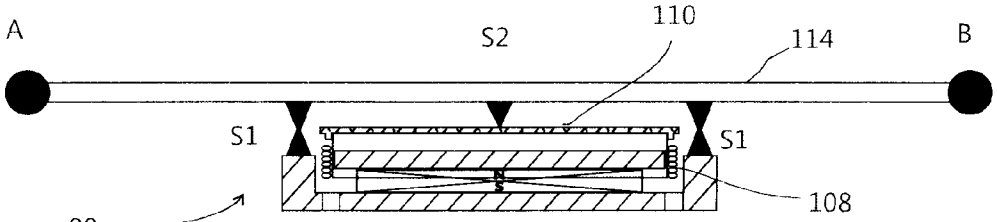

FIG. 11B shows the position of voice coil 108, bobbin top cover 110 and panel 114 in the neutral position (no signal applied to voice coil 108).

Figure 11C:
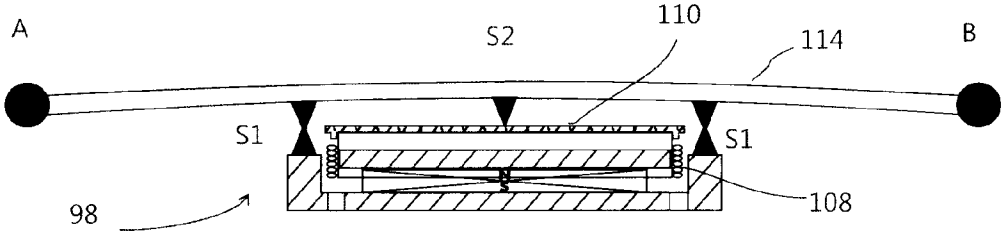

FIG. 11C shows the position of voice coil 108, bobbin top cover 110 and panel 114 with the signal on voice coil 108 having driven the bobbin and the top cover upward with the top of panel 114 assuming a convex shape.

Figure 11D:
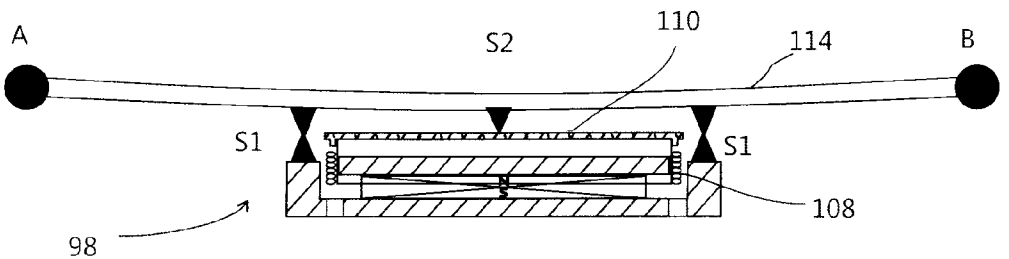

FIG. 11D shows the position of voice coil 108, bobbin top cover 110 and panel 114 with the signal on voice coil 108 having drawn the bobbin and the top cover downward with the top of panel 114 assuming a concave shape.

Referring again to FIG. 11A, given that flexible seals A and B isolate the movement of panel 114 from panel portions 114', suspended electromagnetic motor 98, panel 114, panel portions 114', flexible seals A and B and enclosure 116 provide an acoustic radiator having a coaxial active speaker working area (dimension D) and a passive speaker working area (dimension $D_P$).

Figure 12A:
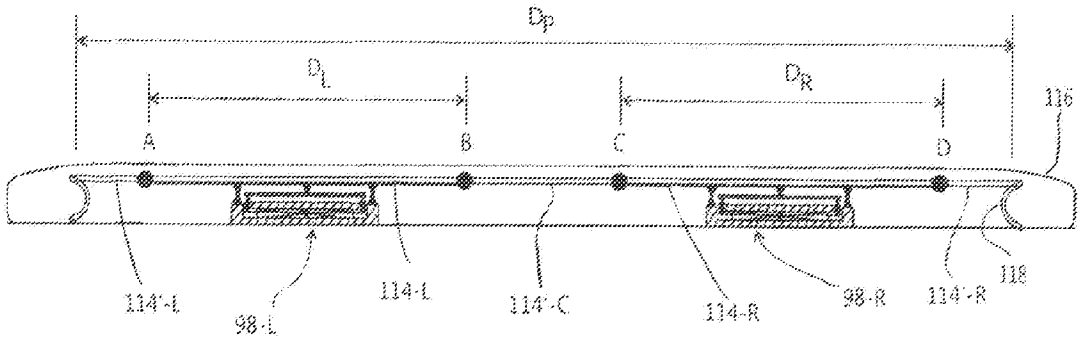
FIG. 12A illustrates an example application of the suspended electromagnetic motor acoustic radiator of FIG. 10 in a low height enclosure in a stereo configuration.
Figure 12B:
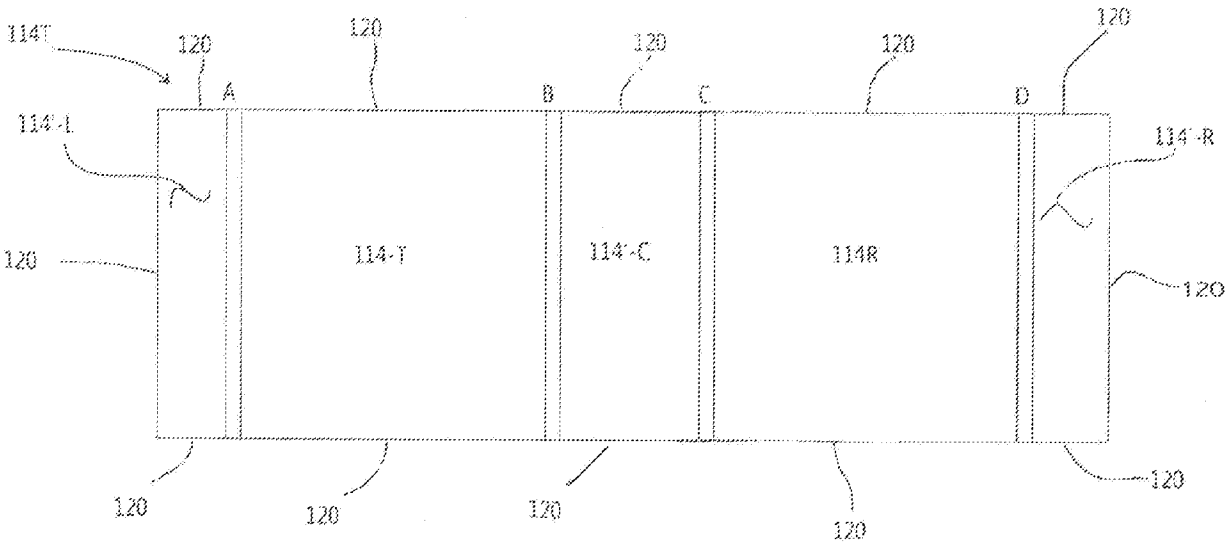
FIG. 12B is a top view of the overall radiating panel of FIG. 12A.

FIGS. 12A-B, are a cross-sectional slice and a top view, respectively, that illustrate an example application of the suspended electromagnetic motor acoustic radiator of FIG. 10 in a low height enclosure in a stereo configuration similar to the configuration of FIGS. 11A-D. In this configuration there are left and right active speaker regions. The left active speaker region has a suspended electromagnetic motor 98-L suspended from a panel 114-L and the right active speaker region has a suspended electromagnetic motor 98-R suspended from a panel 114-R. The left active speaker panel 114-L attaches to panel sections 114'-L and 114'-C with flexible seals A and B, respectively, while the right active speaker panel 114-R attaches to panel sections 114'-C and 114'-R with flexible seals C and D respectively.

In FIG. 12A the dimension of the left active speaker region is indicated as $D_L$, the right active speaker region is indicated as $D_R$ thus providing stereo sound. The active passive region is indicated as $D_P$ which incorporates all of panels 114'-L, 114-L, 114'-C, 114-R and 114'-R with the active passive regions providing a monaural woofer response. Referring to FIG. 12B all of the edges 120 of panels 114 and 114' (other than those that connect to another panel at A, B, C or D) are supported from the bottom of enclosure 116 by a suspension 118 in the fashion shown in FIG. 11A.

Figure 12C:
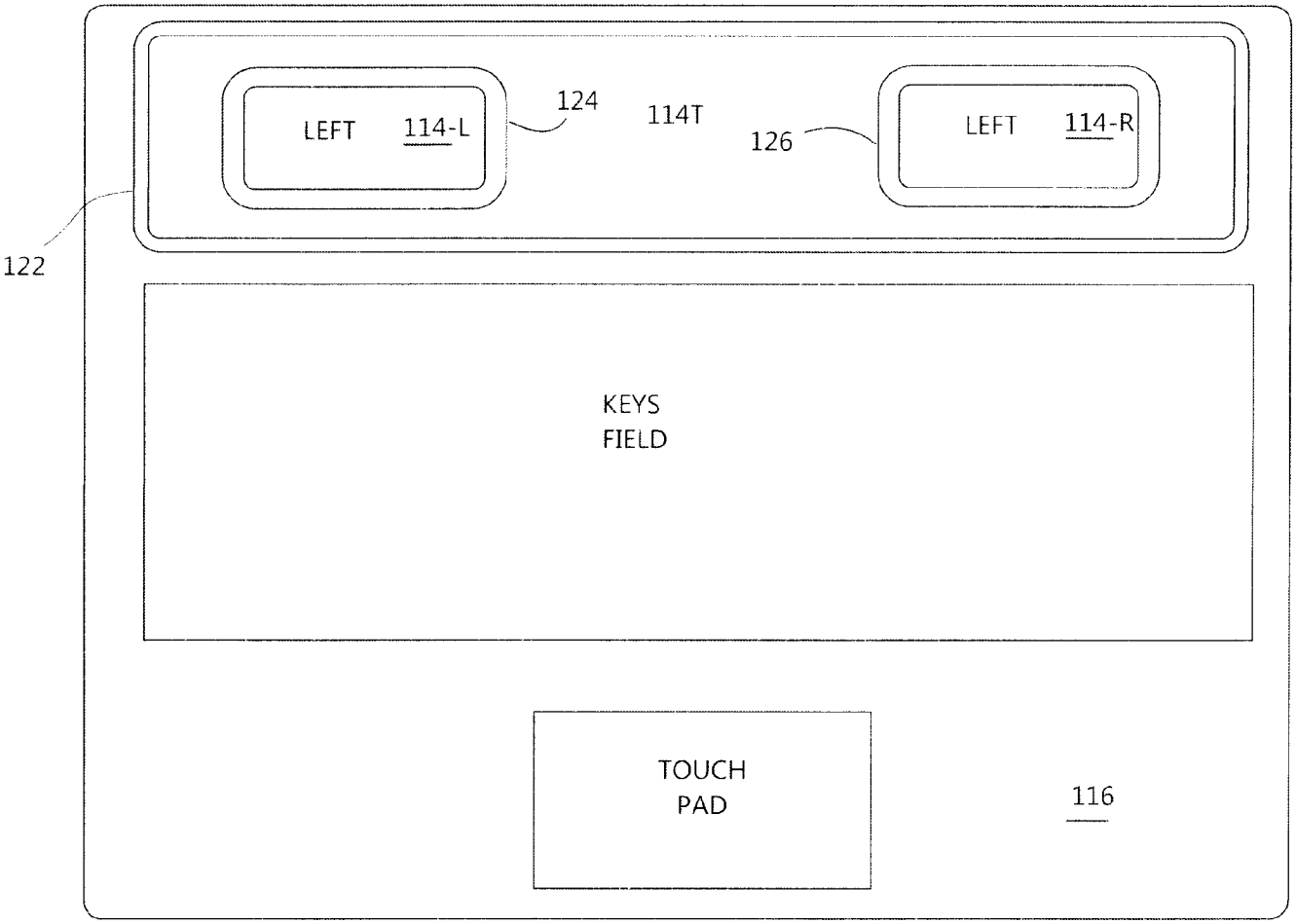
FIG. 12C is a top view of a simplified computer keyboard illustrating the inclusion of an example of a stereo acoustic radiator panel.

FIG. 12C is a top view of a simplified typical computer keyboard that includes of an example of a stereo acoustic radiator panel of FIGS. 12*a* and B. At the front there is a typical touch pad and in the central region is a standard keys field with the various standard keys. Shown behind the keys field is a variation of the location of the radiating panels 114 shown in FIG. 12A. In FIG. 12A the radiating panels 114 are located beneath the top cover of the keyboard enclosure whereas in FIG. 12C a section of the top cover behind the keys field has been cut-out so that the radiating panels 114 can be mounted at the same level as the keys field and touch pad. In this view the total radiating panel 114T is shown supported in the above described opening in the top cover of the keyboard enclosure with a flexible mounting 122 that fully encircles panel 114T connecting the outer edge of panel 114T with the top cover opening. Then within total panel 114T near each end thereof there are two smaller openings in which left panel 114-L and right panel 114-R are mounted with encircling flexible mountings 124 and 125, respectively. As in FIG. 12A, on the under side left panel 114-L and right panel 114-R are mounted motors 98-L and 98-R, respectively. Thus, in this configuration, the active radiating areas are the area of each of left panel 114-L and right panel 114-R and the passive radiating area is the total area of panels 114T, 114-L and 114-R. In this configuration panels 114-L and 114-R provide stereo sound while the total passive response is monaural.

Figure 12D:
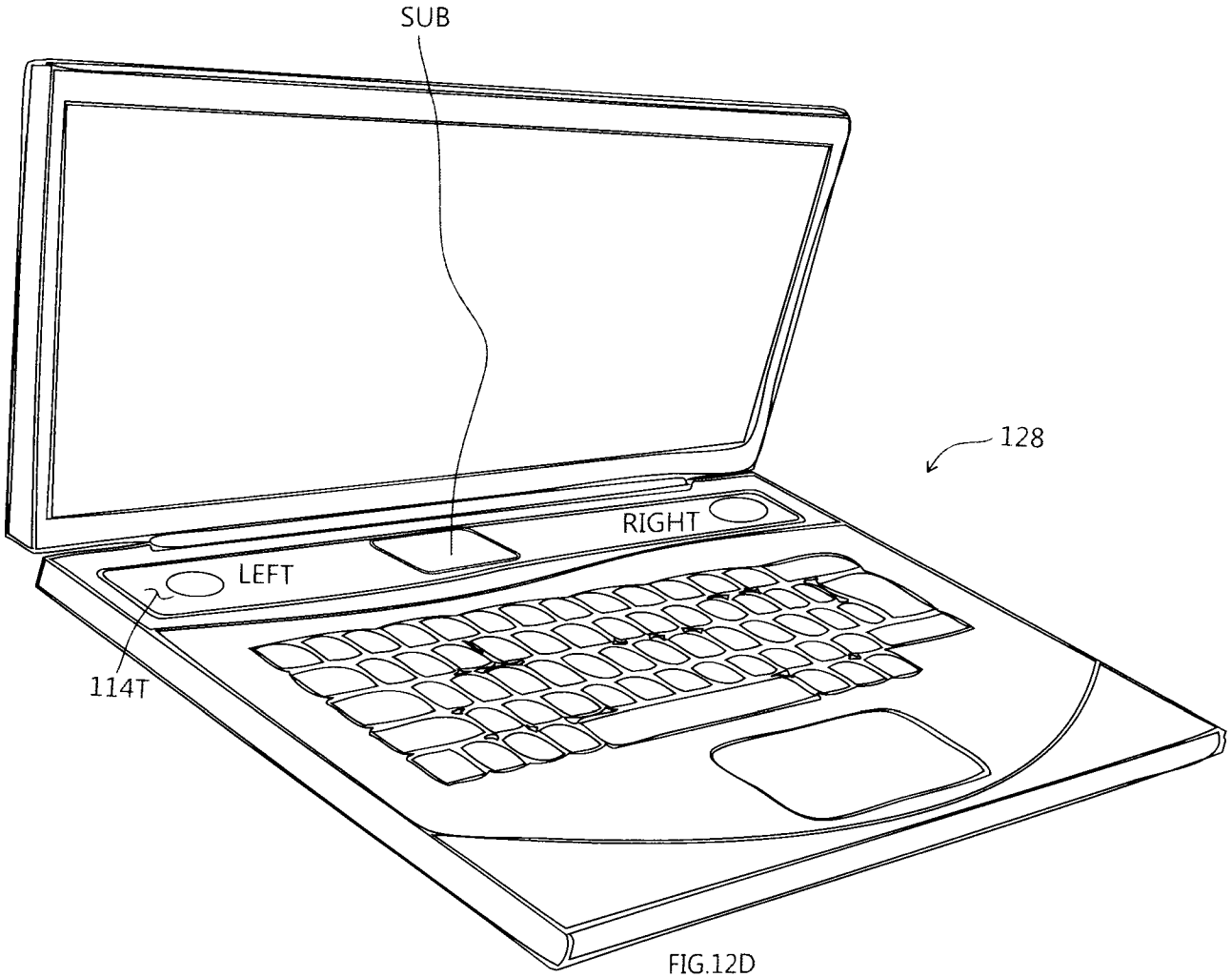
FIG. 12 D is a perspective view of a notebook computer incorporating the feature of FIG. 12C plus a sub-woofer in the radiating panel.

FIG. 12D is a perspective view of a notebook computer 128 incorporating radiating panel 114T with the stereo left and right radiating areas plus a centrally located monaural subwoofer radiating area in the center flexibly mounted as are the left and right areas. Thus, the radiating configuration of FIG. 12D has three active radiating areas (left, right and subwoofer) with the passive radiating area being the total area of panel 114T inclusive of the active radiating areas.

Figure 13A:
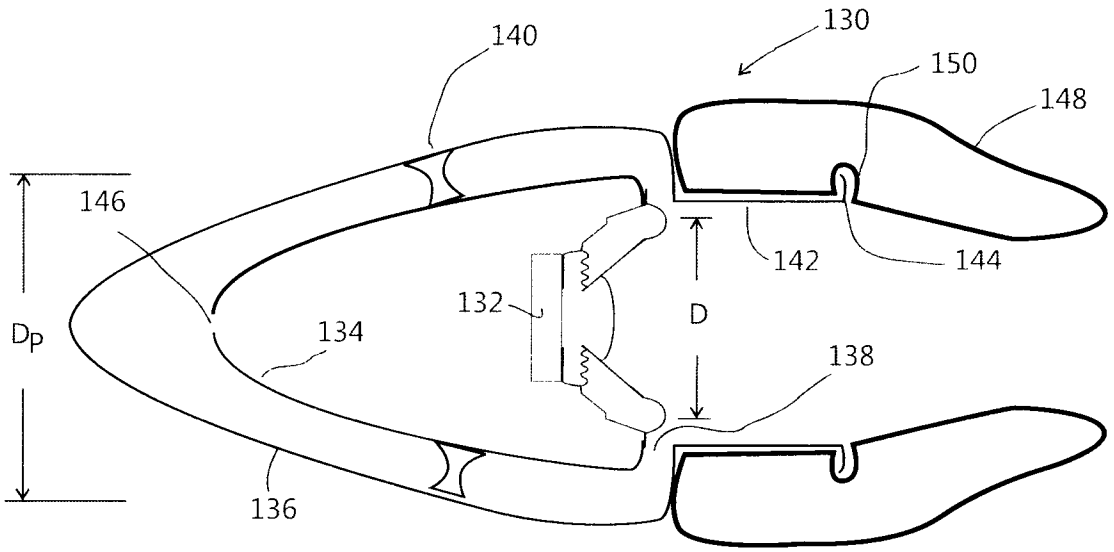
FIG. 13A is a cross-sectional slice of an in-ear headphone coaxial acoustic radiator.

FIG. 13A is a cross-sectional slice of an in-ear headphone 130 that includes a coaxial acoustic radiator. The acoustic radiator portion includes an inner shell 134 with a miniature speaker 132 flexibly attached to the opening similarly to the mounting shown in previously discussed examples (e.g., FIG. 2A), and extending into the inner cavity, thereof. Surrounding, and spaced-apart from, inner shell 134 is an outer shell that is secured in position with a flexible interconnect 140 defining a second cavity between the inner shell 134 and outer shell 136. Mounted in this fashion the open end of outer shell 136 is adjacent to and separated from the open end of inner shell 134 and speaker 132 forming a passage 138 therebetween to allow free movement of speaker 132 without coming into contact with either the outer shell 136 and the inner shell 134, other than at the point of mounting with the inner shell 134 via flexible interconnects 140.

Outer shell 136 also includes, extending outward from the open end at passage 138 a mounting surface 142 with an outwardly extending flange 144. A flexible ear cup 148 having a mounting recess 150 formed therein is secured on mounting surface 142 with flange 144 having been received in mounting recess 150.

Additionally, a vent hole 146 can be provided through inner shell 134 to share variations in the air pressure within inner shell 134 with the interior of outer shell 136. Further flexible interconnect 140 allows vibration of inner shell 134 and by changing the flexibility or stiffness of interconnect 140 the resonance can be tuned. This double suspension design also reduces vibrational noise from entering the ear canal of the wearer with noise that occurs outside the outer shell 136 considerably reduced since it has to travel through the walls of both the outer shell 136 and then inner shell 134 to be transmitted to the wearer's ear In this configuration the active speaker region is D which is the combination of the speaker cone and surround while the passive region is $D_P$ the full opening of inner shell 134 including the active region.

Figure 13B:
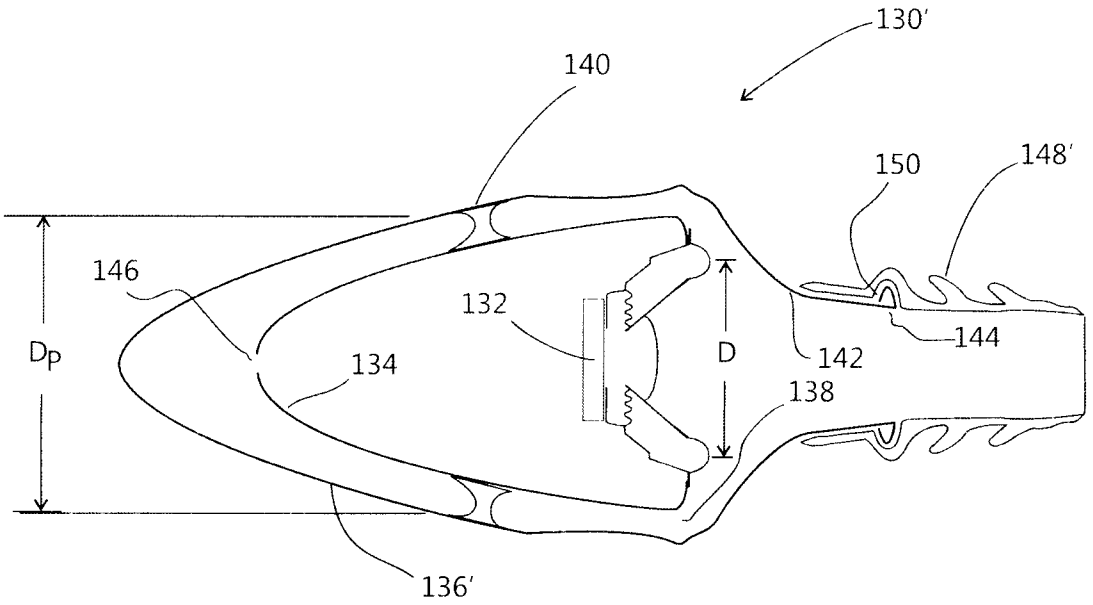
FIG. 13B shows another embodiment of an ear piece that has a flexible membrane that reduces the noise into the ear canal.

FIG. 13B is a cross-sectional slice of an in-ear headphone 130' which is a variation of the design of FIG. 13A with outer shell 136' having a modified outer surface shape and a modified ear piece 148' that includes a series of spaced apart flexible circular projections which when the ear piece 148' is inserted into the ear of the wearer, those flexible projections expand in the ear canal and aid in blocking external sound from reaching the wearer's ear drum thus improving the perceived performance of the head phone.

Figure 14A:
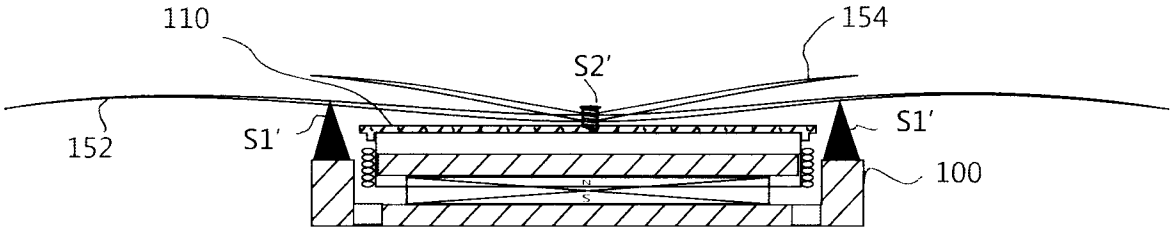
FIG. 14A is a partial cross-sectional view of another example of a coaxial acoustic radiator motor that is similar to the motor of FIG. 10 that is to be suspended from a radiating panel.

FIG. 14A is a partial cross-sectional view of another example of a coaxial acoustic radiator motor 98' that is similar to motor 98 of FIG. 10A. The differences between motor 98 and motor 98' are all on the top portion of the motor in the function of S1' and S2' as opposed to S1 and S2 of FIG. 10A. In addition, motor 98' includes sound radiating elements that are not present in motor 98. In FIG. 14A suspension S1' is connected to and encircles the top edge of bottom plate 100 as does suspension S1 in motor 98, however the top of suspension S1' does not connect to the bottom of a radiating panel and S2' is not a suspension, instead it is a connection in center of the top of bobbin top cover 110.

At point S2' on the top of bobbin top cover 110 the center of two radiating elements are connected; a larger diameter lower frequency radiating element 152 on the bottom and a smaller diameter higher frequency radiating element 154 on top with the only contact point in common between elements 152 and 154 being at connection point S2'. The larger diameter lower frequency radiating element 152 is supported on the under side by suspension S1' approximately mid-way between the center and the outer edge thereof. The smaller diameter higher frequency radiating element 154 is only supported in the center. The shape of each of radiating elements 152 and 154 will be similar to a low height cone.

Figure 14B:
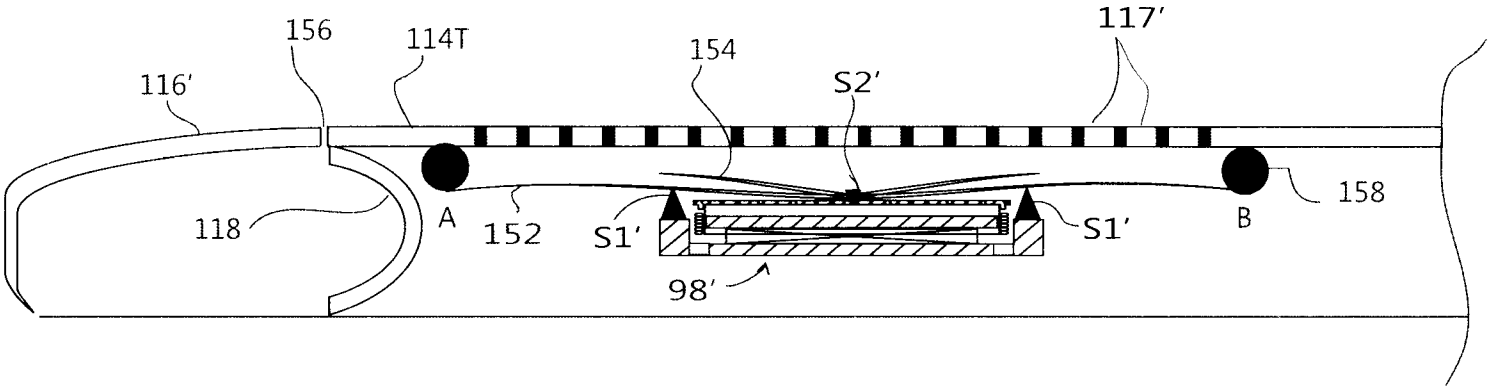
FIG. 14B is the left end of a low height enclosure (e.g., a notebook computer) with the radiating panel construction similar to that shown in FIG. 12C with the motor of FIG. 14A mounted to the underside of the left portion of the radiating panel.

FIG. 14B is the left end of a low height enclosure (e.g., a notebook computer) with the radiating panel 114T construction similar to that shown in FIGS. 12A and C with the motor of FIG. 14A mounted to the underside of the left portion of the radiating panel. For the stereo effect of the configuration of FIG. 12C, a second motor 98' will be mounted under the right end of radiating panel 114T in the same manner as shown here. Shown here radiating panel 114T is shown supported in opening 156 in enclosure 116' from below by flexible suspension 118. Alternatively, radiating panel 114T can be supported as in FIG. 12C with passive radiating panel flexible seal 122.

In this view it can be seen that motor 98' is suspended entirely from the outer edge of lower frequency radiating element 152 between points A and B with an O-ring 158 that is attached to the outer edge of radiating element 152 and in turn is attached to the underside of panel 114T below openings 117' through panel 114T. In this structure lower frequency radiating element 152 can be made of paper, plastic or any material that has some flexibility and can radiate sound with radiating element 152 being curved as shown to reduce cone noise and flexing.

For higher frequency radiating element 154 to operate properly there needs to be sufficient space between motor 98' and the under side of panel 114T to allow element 154 to flex without coming into contact with the underside of panel 114T and motor 98' other than at point S2'. To provide the needed space, the thickness O-ring 158 must have sufficient thickness. In this design, radiator 154 is smaller and lighter weight than radiating element 152 to be able to respond faster having a higher resonance than radiator 152 to provide tweeter performance given that the outer edge is free to move thus having a higher efficiency in the higher frequencies than the larger radiator 152.

Figures 15A, 15B:
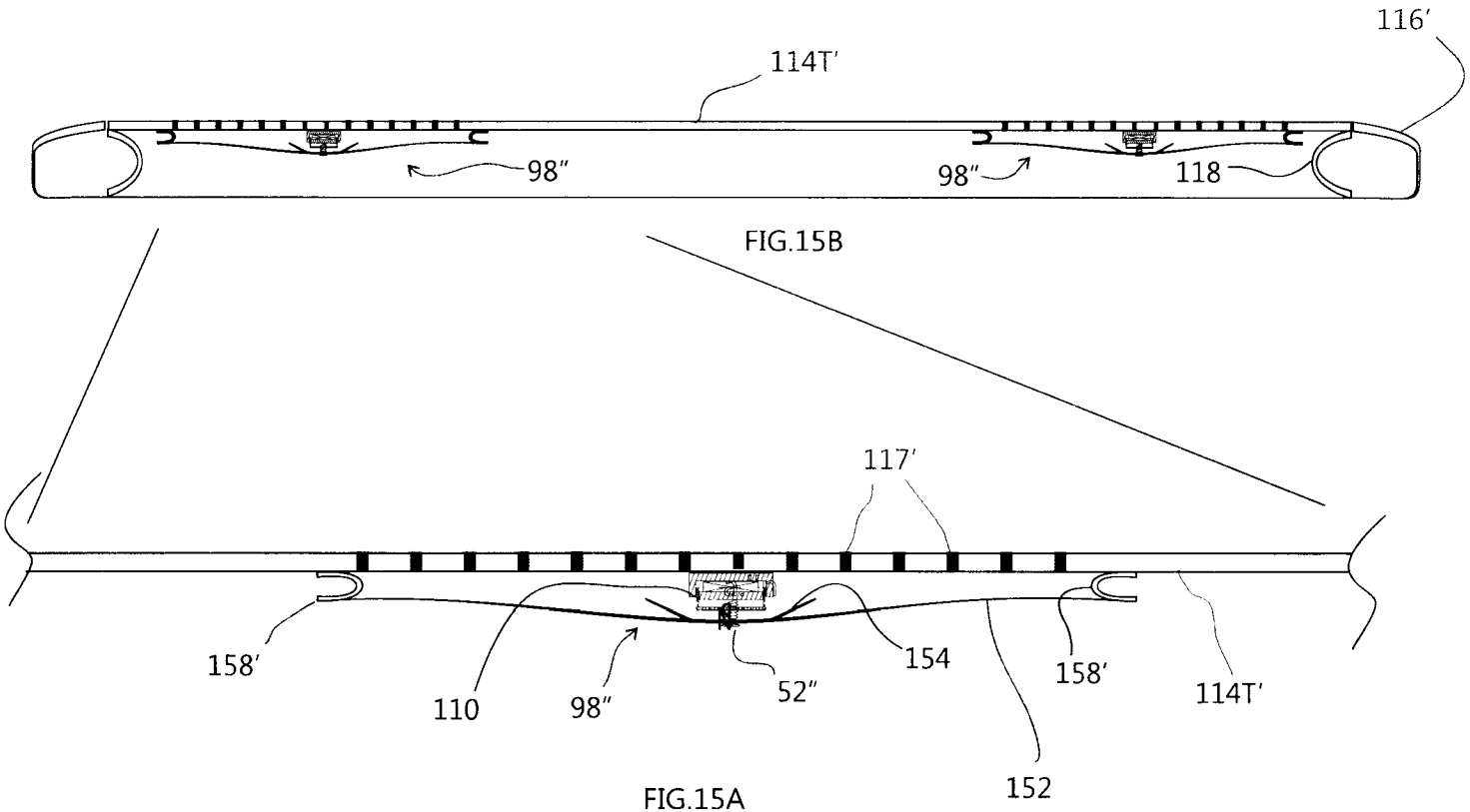
FIG. 15A is a left section of the radiation panel of a low height enclosure (e.g., a notebook computer as in FIG. 15B) with the radiating panel construction similar to that shown in FIG. 12C with a modified motor of FIG. 14A invertedly mounted to the underside of the left section of the radiating panel.
FIG. 15B is a partial cross-sectional view of yet another example of a coaxial acoustic radiator motor that is similar to the motor of FIG. 10 that is suspended from a radiating panel of a low height enclosure (e.g. notebook computer)

FIG. 15A is a left section of a radiation panel 114T' of a low height enclosure (e.g., a notebook computer [see FIG. 15B] with the radiating panel construction similar to that shown in FIG. 12C with a modified motor 98" of FIG. 14A inverted and mounted to the underside of the left section of the radiating panel 114T'. As shown here the bottom of motor 98" is mounted directly on the bottom of radiating panel 114T' adjacent to the sound holes 117'. In this configuration the top of bobbin top cover 110 is facing downward with a centered spacer S2" pointing downward. The center of each of higher frequency radiating element 154 and lower frequency radiating element 152 are concentrically attached to spacer S2", each opening upward toward panel 114T' with higher frequency radiating element 154 mounted closer to panel 114T' than lower frequency radiating element 152. The outer edge of higher frequency radiating element 154 is not attached to anything as in motor 98' in FIGS. 14A and 14B, while the outer edge of lower frequency radiating element 152 is coupled to one side of a flexible membrane 158' that totally encircles element 152 with the other side of flexible membrane coupled to the under side of panel 114T' fully spanning sound holes 117'.

FIG. 15B is a partial cross-sectional view of a pair of coaxial acoustic radiator motors 98" suspended from radiating panel 114T' in a stereo configuration similar to that of FIG. 12A. In this configuration, as in the other similar configuration discussed above, the internal pressure variations within enclosure 116' are a function of both the passive suspensions and the active frequencies emitted by lower frequency radiating elements 152 and higher frequency radiating elements 154.

With respect to FIGS. 11A through 12D and FIGS. 14A through 15B what is disclosed relates to an active speaker, transducer or vibrator mounted on a moving passive radiator surface so the active component will generate a motion in the passive radiator in response to the active component.

By mounting the active component on the surface of the passive radiator, the weight of moving mass the passive radiator is tunable to resonate at a selected resonance frequency. The passive radiator resonance frequency, Fp, is proportional to the ratio of the mass of the stiff passive radiator divided by the total moving mass of the acoustic radiator (i.e. the passive radiator with the active component attached thereto).

Fp=~Cp/mmp where Fp is the resonance of the passive radiator in a given volume box, Cp is the surround compliance, and mmp is the total moving mass of the passive-active combination. Since the active component is mounted on the surface of the passive radiator, the mass of the active component is part of the total moving mass. With the active component suspended within the enclosure from the passive radiator panel, and since active component is applying negative and positive pressure into and out of the enclosure as it responds as a signal is applied thereto, its coil and associated parts move inward/outwards creating pressure on the passive radiator component. Since for every action there is an equal and opposite reaction, for an inward or outward stroke of the coil pressure is applied to the combined mass of the passive and active components causing to move inward or outward at a speed V. This causes development of momentum energy that is equal to the total moving mass, X, times the velocity, i.e., M*V. These embodiments of the acoustic radiator of the present invention benefit from that momentum energy, as well as kinetic energy, due to direct coupling of the active and passive components.

Figure 1A:
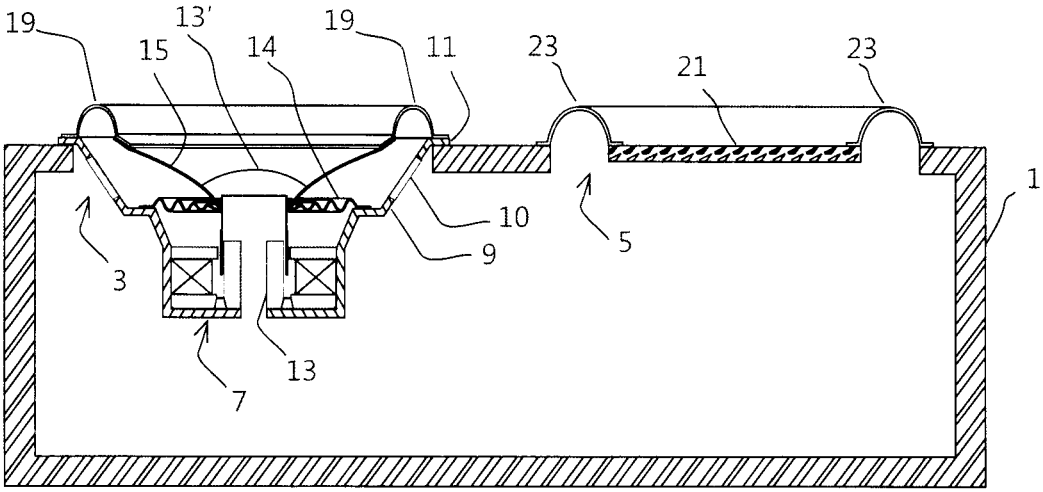
FIG.1A (PRIOR ART)
FIG. 1A is a vertical cross-sectional slice of a side view of a simplified view of an audio speaker/passive radiator and enclosure combination of the prior art.
Figure 1B:
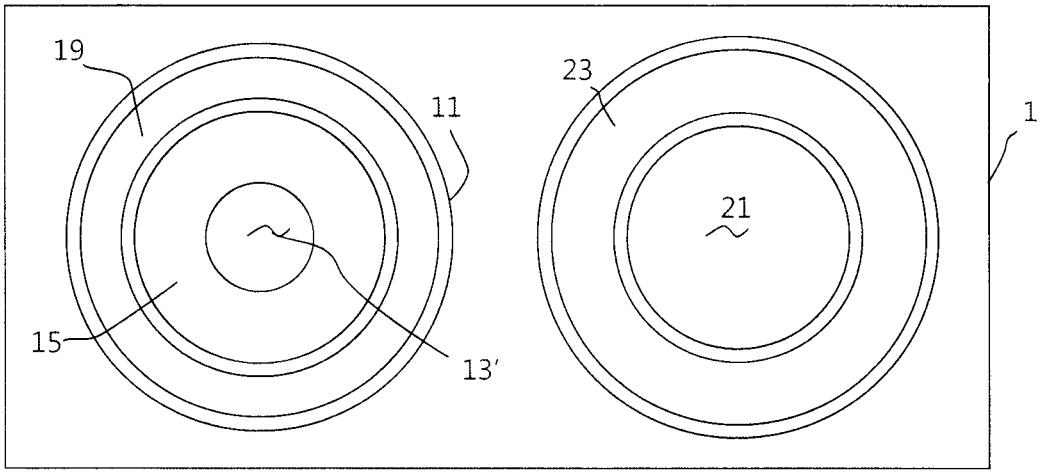
FIG.1B (PRIOR ART)
FIG. 1B is a top view of the simplified view of the audio speaker/passive radiator and enclosure combination of the prior art of FIG. 1A.

Prior art systems had only compressible fluid (e.g. air in the closed enclosure—see FIG. 1A) as the median that transfers energy from the active component to the passive component. In each of the embodiments of the current invention, as illustrated in each of the figures, the energy transferred results from a combination of a compressible fluid plus direct coupling of the active and passive components.

Figure 16A:
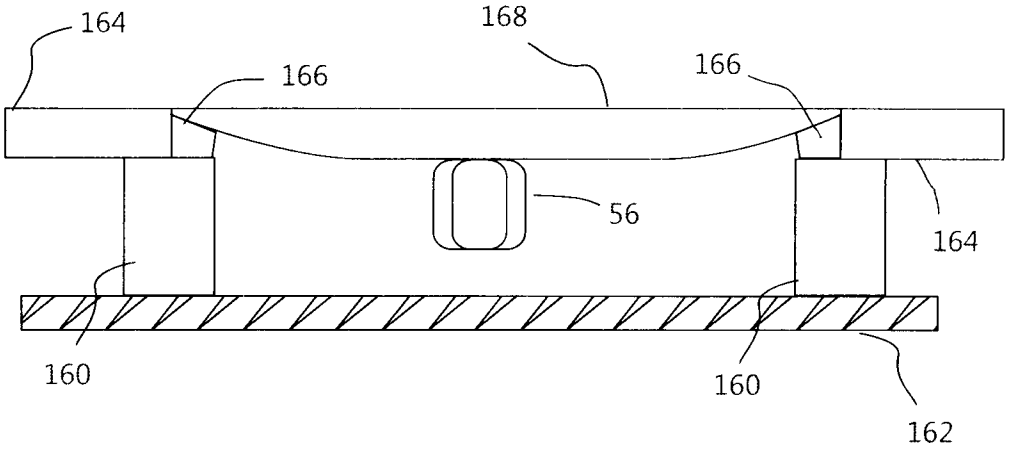
FIG. 16A a horizontal cross-section of a section of an interior wall that has been made an acoustic radiator with a vibrating element mounted within the space between two studs in a section of a wall.
Figure 16B:
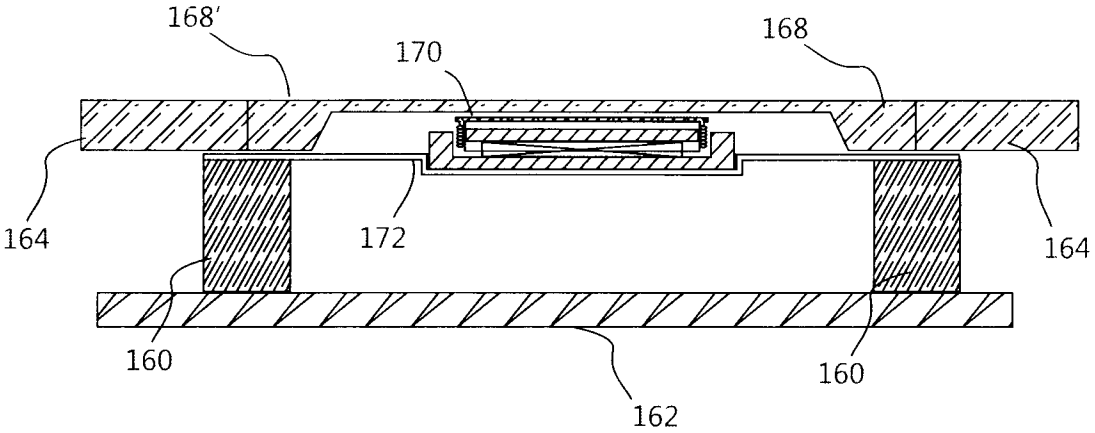
FIG. 16B a horizontal cross-section of a section of an interior wall that been made an acoustic radiator with an active speaker mounted within the space between two studs in a section of a wall.

FIGS. 16A and 16B each illustrate an example of a section of an interior building wall converted to a coaxial acoustic radiator. In typical construction interior walls are constructed with floor to ceiling 2×4 studs 160 mounted vertically on 16 inch centers back and front wall panels 162, 164 attached vertically on opposite sides of studs 160 forming walls in two adjacent rooms. An interior space is created between adjacent studs 160 that is approximately 4 inches deep, 14 inches wide and as tall as the distance from floor to ceiling in the interior room (in a typical home that height is 8 feet). In exterior walls insulation is typically installed in the space between the studs, however in interior walls, while there may be some electrically wiring, electrical outlets, wall switches or horizontal fire breaks within the walls, most of the space within interior walls is empty. Thus that empty space within the walls could be converted to a built-in acoustic radiator.

FIG. 16A illustrates a horizontal cross-section of an empty space in a section of an interior wall with a section of one of the wall panels replaced with a patterned radiating panel 168 extending between centers of two adjacent studs 160. Patterned radiating panel 168 is shown having thinned vertical edges so that they do not come into direct contact with stud 160 and are alternatively attached to studs 160 with a bead of flexible material 166 (e.g., silicone). On the inside surface of patterned radiating panel 168 there is shown a vibrating element 56 similar to that shown in FIGS. 5A and B to selectively activate the patterned radiating panel 168. Depending on the desired effect and the extent of the empty space within the desired section of the interior wall, the patterned radiating panel 168 could be from a few inches in height to the entire height of the wall with flexible material 166 joining panel 168 to other sections of the static wall material and the ceiling and floor for a full height patterned radiating panel 168.

Similarly, FIG. 16B illustrates a horizontal cross-section of an empty space in a section of an interior wall with a section of the wall panel replaced with a patterned radiating panel 168' having a thinned center section to accommodate a low profile speaker motor 170 sandwiched between the inside surface of patterned radiating panel 168' and a minimally flexing support 172 spanning the space between adjacent studs 160 with the top of the bobbin cover of speaker motor 170 glued to patterned radiating panel 168' and the bottom plate of speaker motor 170 supported on minimally flexing support 172. As with the vibrating configuration of FIG. 16A, in the speaker equipt configuration of FIG. 16B, depending on the desired effect and the extent of the empty space within the desired section of the interior wall, the patterned radiating panel 168 could be from a few inches in height to the entire height of the wall with flexible material 166 joining panel 168' to other sections of the static wall material or the ceiling and floor for a full height patterned radiating panel 168'.

In FIG. 17 there is shown a cross-sectioned enclosure 30' that is curved having a different radii of curvature throughout with an opening in curved top portion with an acoustic radiator of the present invention mounted in, and extending through, that opening. Centered and extending into enclosure 30' through that opening is a fully functional typical audio speaker similar to that shown in FIG. 2A. The upper part of the speaker frame is shown with sliced through typical vent holes 10' and a flexible surround 44' interconnecting the top edge of speaker cone 40 with the outer edge of the speaker frame as in FIG. 2A.

In turn speaker assembly is suspended within the curved opening of enclosure 30' with three additional elements. A first of those elements is mounted directly to the curved opening of enclosure 30' is a ring 31' shaped to fit the space of the opening with ring 31' have a "Z" shaped cross-section (two circular vent holes are visible on each side) that can be seen abutting the edge of the opening in enclosure 30' on both side of that opening. The outer "leg" of the "Z" shape extends over the solid outer surface of enclosure 30' and the inner "leg" of the "Z" inside enclosure 30' extends away from the edge of the opening of enclosure 30' a short distance but not far enough to come into contact with any portion of the speaker.

A second of those three elements is a first flexible membrane 48', which for convenience is shown in this view as a second surround, is attached between the outer edge of the speaker frame at the point were the outer edge of surround 44' is attached and the top of the outer "leg" of the "Z" shape of ring 31'.

The third of those three elements is a second flexible membrane 50, which for convenience is shown in this view as a third surround extending downward into the interior of enclosure 30', is attached between a point on the speaker frame opposite the spider within the speaker and the inner "leg" of the "Z" shape of ring 31'.

Note that in this configuration the speaker is fully suspended by first and second flexible membranes 48' and 50 and at no time does any portion of the speaker, whether powered or unpowered, come into direct contact with enclosure 30'.

Thus it can be seen that FIG. 17 shows a coaxially mounted speaker/passive radiator that has a curved face to match the shape of the opening into which it is mounted. Since surface to which the coaxially speaker/passive radiator mounted is curved, both the passive and the active elements shown have a the shape of a partial spherical face that allows for wider angle of dispersions with linear sound pressure level. A curve active/passive radiator of the present invention could also be curved only in one direction (e.g. mounted in circular vertical column or in a concave or convex curved wall). Additionally, for instance, the speaker face could be made to have a shape of ½ circle with no curve height. This would allow the speaker to radiate linear sound into wider range of seating in a room.

Additionally, while enclosure 30' is shown having a curved surface all around, the shape of the enclosure at some point behind the curved surface to which it is mounted might not be visible to the area into which the acoustic radiator of the present invention is broadcasting the sound, or that portion of the selected enclosure to which it is mounted might not have curved surfaces. That portion of the enclosure behind the curved mounting surface, can have any shape so long as the interior speaker does not come into contact with the interior of the enclosure.

Furthermore, as stated previously, the shape of the acoustic radiator of the present invention can be any desired shape (e.g., round oval or any other desired shape) and the opening of the frame of the speaker could be shaped to match the surface of the opening into which the acoustic radiator of the present invention is to be mounted (e.g., a round pillar, a convex or concave shaped wall or even a surface that has a different horizontal radius of curvature from the vertical radius of curvature to match the décor where placed or to enhance performance (e.g., to focus the radiation or to broaden the angle of radiation from the acoustic radiator of the present invention).

This invention pertains to flexibly mounting an acoustic radiator, or a tactile transducer (e.g., vibrator), to an enclosure or a surface for creating sound or canceling it. Further more this invention is about tuning the frequencies of the system by changing the compliance, i.e. the stiffness, or the weight of the moving elements to achieve the desired response.

What is claimed is:

1. An active acoustic radiator comprising, in combination:

an audio speaker having a perimeter frame providing inside perimeter dimensions $D_s$ measured from a center of an inside, supporting, impermeable flexible speaker surround within the perimeter frame for generating a desired range and pattern of speaker acoustic frequency vibrations, and outside perimeter dimensions;

an outside, supporting, impermeable, flexible passive surround having an inner edge secured around the perimeter frame providing outside perimeter dimensions $D_p$ measured from a center of the outside, supporting, impermeable, flexible passive surround, where the outside, supporting, impermeable, flexible passive surround is configured for attaching to and sealing an opening into a 3-dimensional acoustic enclosure suspending the audio speaker within the acoustic enclosure and creating a passive radiator having moving mass $M_p$ approximately equal to a sum of:

(i) a mass $M_s$ of the audio speaker including the perimeter frame, and the inside, supporting, impermeable flexible speaker surround;

(ii) a mass $M_{ps}$ of the outside, supporting, impermeable, flexible passive surround; and (iii) an air load mass $M_{AL}$ encountered within the acoustic enclosure driven by the audio speaker acoustic frequency vibrations when energized;

for generating a desired range and pattern of related lower passive acoustic and tactile frequency vibrations based upon relationships of respective areas determined by the respective inside and outside perimeter dimensions $D_s$ and $D_p$ of the perimeter frame and the mass $M_p$ of the passive radiator.

2. The acoustic radiator of claim 1 where the outside, supporting, impermeable, flexible passive surround has a selected stiffness matched to the mass $M_s$ of the audio speaker to provide a desired tuning frequency.

3. The acoustic radiator of claim 1 or 2 further including a rigid perimeter collar rigidly fastened around the perimeter frame of the audio speaker, where the supporting outside supporting, impermeable, flexible passive surround has an inner edge secured around the rigid perimeter collar for increasing the mass and the outside dimensions $D_p$ of the audio speaker.

4. The acoustic radiator of claim 1 where the 3-dimensional acoustic enclosure flexibly expands and contracts responsive to acoustic and tactile frequency air pressure vibrations.

5. The acoustic radiator of claim 1 wherein:

the 3-dimensional acoustic enclosure has a curved surface with an opening of a selected configuration where the perimeter frame and the outside, supporting, impermeable, flexible passive surround are each configured smoothly conform to the curved surface of the acoustic enclosure around the opening into the acoustic enclosure for hermetically closing the opening.

6. The acoustic radiator of claim 2 further including resilient support between the audio speaker and the enclosure to prevent the audio speaker suspended within the enclosure from coming into contact with the enclosure when the audio speaker is activated.

7. An active acoustic and tactile air pressure radiator comprising, in combination:

a) a sealed enclosure containing air having a rigid planar radiating surface with a central axis supported by an airtight flexible surround;

b) an electromagnetic motor within the enclosure having:

(i) a ferromagnetic receiving receptacle smaller than the rigid planar radiating surface with an open top end, and a vented closed bottom end, (ii) a magnet with a top ferromagnetic plate coaxially received in the ferromagnetic receiving receptacle, and (iii) a bobbin with a closed top end and an open bottom end having a surrounding voice coil received in a vertically oriented annular space provided between inside walls of the receiving receptacle and outside walls of the received magnet and top ferromagnetic plate, all oriented coaxially with the central axis of the planar radiating surface;

c) a coaxial resilient coupling between the coaxial center of the closed top end of the of the bobbin and the rigid planar radiating surface coaxially aligned with central axis of the radiating surface;

d) a resilient airtight perimeter coupling between the open top end of the ferromagnetic receptacle and the rigid planar radiating surface coaxially aligned with its central axis; and e) means for electrically energizing the voice coil for inducing the bobbin to vibrate up and down in the vertically oriented annular space between inside walls of the receptacle and outside walls of the smaller magnet and top ferromagnetic plate.

8. In a flat frame speaker having:

a speaker motor with a bottom ferromagnetic receptacle coaxially receiving a smaller magnet and top ferromagnetic plate with a bobbin coaxially received in an annular space between walls of the receptacle and the magnet and the top ferromagnetic plate;

a rigid caging structure coaxially secured to the bobbin symmetrically expanding radially outward away from the bobbin providing a distal edge;

an inverted cone coaxially secured to and suspended from the distal edge of the caging structure above the bobbin with its apex proximate the bobbin, a planar frame pan configured for coaxially receiving, securing and supporting the speaker motor with vent holes symmetrically located around the supported speaker motor, and having a raised perimeter shoulder integrally presenting a perpendicular inside faces and a parallel outside faces, and an impermeable flexible surround secured between the perpendicular inside faces presented by the perimeter shoulder of the planar frame pan and the distal edge of the rigid caging structure securing and suspending the inverted cone;

an improvement, in combination therewith, comprising:

a) an acoustic enclosure with an opening; and b) at least a second impermeable flexible surround secured between the parallel outside faces of the perimeter shoulder of the planar frame pan and the opening of the acoustic enclosure hermetically closing the opening into the acoustic enclosure.

* * * * *